US007192107B2

(12) United States Patent
Fukano et al.

(10) Patent No.: US 7,192,107 B2
(45) Date of Patent: Mar. 20, 2007

(54) INFORMATION COMMUNICATING MEMBER, LIQUID CONTAINER HAVING INFORMATION COMMUNICATING MEMBER AND LIQUID EJECTING APPARATUS

(75) Inventors: Takakazu Fukano, Nagano (JP); Yasuto Sakai, Nagano (JP); Tomio Yokoyama, Nagano (JP); Kenji Ito, Nagano (JP); Yoshiharu Aruga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 275 days.

(21) Appl. No.: 10/828,766

(22) Filed: Apr. 20, 2004

(65) Prior Publication Data

US 2005/0012766 A1 Jan. 20, 2005

(30) Foreign Application Priority Data

Apr. 21, 2003 (JP) ..... P2003-115656
Apr. 21, 2003 (JP) ..... P2003-115657

(51) Int. Cl.
*B41J 2/195* (2006.01)
*B41J 29/393* (2006.01)

(52) U.S. Cl. ..... 347/7; 347/19

(58) Field of Classification Search ..... 347/7
See application file for complete search history.

(56) References Cited

U.S. PATENT DOCUMENTS

2001/0019343 A1* 9/2001 Walker et al. ..... 347/19
2002/0030714 A1 3/2002 Walker
2003/0128245 A1* 7/2003 Walker ..... 347/7

FOREIGN PATENT DOCUMENTS

| | | | |
|---|---|---|---|
| EP | 1 088 668 | A1 | 4/2001 |
| EP | 1 213 148 | A1 | 6/2002 |
| JP | 11-170498 | A | 6/1999 |
| JP | 2001-063097 | A | 3/2001 |
| JP | 2001-071469 | A | 3/2001 |
| JP | 2001-138503 | A | 5/2001 |
| JP | 2001-191511 | A | 7/2001 |
| JP | 2002-005724 | A | 1/2002 |
| JP | 2002-127459 | A | 5/2002 |
| JP | 2002-234192 | A | 8/2002 |

OTHER PUBLICATIONS

EPO Search Report EP 04 00 9408 (Aug. 5, 2004) (in English).

* cited by examiner

*Primary Examiner*—Manish S. Shah
*Assistant Examiner*—Jannelle M. Lebron
(74) *Attorney, Agent, or Firm*—Stroock & Stroock & Lavan LLP

(57) ABSTRACT

An information communicating member is adapted to be disposed on a liquid container for supplying a liquid to a liquid ejecting head of a liquid ejection apparatus. The information communicating member includes: an information storing portion storing therein liquid information with regard to the liquid contained in the liquid container; an antenna portion for communicating the liquid information stored in the information storing portion between the information communicating member and the liquid ejection apparatus in a wireless manner; and a base member on which the information storing portion and the antenna portion are disposed. The base member has an electric insulating property and an ultraviolet ray shielding property.

9 Claims, 17 Drawing Sheets

INFORMATION COMMUNICATING MEMBER, LIQUID CONTAINER HAVING INFORMATION COMMUNICATING MEMBER AND LIQUID EJECTING APPARATUS

BACKGROUND OF THE INVENTION

The present invention relates to an information communicating member capable of transmitting and receiving information with regard to a liquid contained in a liquid container to and from a main body of a liquid ejecting apparatus by wireless communication. The present invention also relates to a liquid container having an information communicating member and a liquid ejecting apparatus to which a liquid container is mountable.

As a liquid ejecting apparatus for ejecting a liquid to a target, there is known an ink jet type recording apparatus for printing by ejecting ink drops from a recording head to a record medium. Such an ink jet type recording apparatus ejects small ink drops from nozzles of the recording head to the record medium to thereby record a desired image of a character, a diagram or the like.

The ink jet type recording apparatus is provided with the recording head and an ink cartridge. The ink cartridge contains ink to be supplied to the recording head.

It is necessary to inform information with regard to ink contained in the ink cartridge to a recording apparatus.

The recording head ejects ink drops from its nozzle openings in such a manner that a drive signal in correspondence with print data is supplied to piezoelectric vibrators or the like, and ink is pressurized by energy generated by the piezoelectric vibrators.

For example, JP-A-2001-71469 (page 3 through page 4, FIG. 5) discloses a system in which in order to confirm whether an ink cartridge is mounted to a holder of a carriage, a circuit board on the ink cartridge side transmits a signal when the circuit board is electrically brought into contact with a holder side contact.

JP-A-2002-234192 (page 8 through page 9, FIG. 3) discloses a system in which information with regard to ink contained in an ink cartridge is transmitted to a recording apparatus side by wireless communication.

The former system in which a signal is transmitted upon direct contact as disclosed in JP-A-2001-71469 suffers from a problem of an electric contact failure.

In the case of the latter system in which a signal is transmitted by wireless communication as disclosed in JP-A-2002-234192, the system is provided at the ink cartridge side with an antenna portion and a non-volatile memory (EEPROM: Electrically Erasable Programmable Read Only Memory) storing therein various information with regard to ink. However, the latter system suffers from a problem that stored data is erased when ultraviolet ray is irradiated thereto.

Further, the non-volatile memory and the antenna are attached to a surface of the ink cartridge and therefore, there poses a problem that by static electricity generated by the human body or static electricity generated by a mechanical portion, the antenna (antenna circuit portion) and the non-volatile memory (also referred to as IC chip) and a sensor terminal provided as necessary are subjected to electrostatic breakdown.

Hence, it is an object of the invention to resolve the above-described problem. Another object of the invention is to provide an information communicating member capable of firmly preventing memory data from being erased by ultraviolet ray. Yet another object of the invention is to provide an information communicating member capable of preventing electrostatic breakdown of an information storing portion for storing information with regard to a liquid and an antenna portion. Still another object of the invention is to provide a liquid container having the information communicating member and a liquid ejecting apparatus to which the liquid container is mountable.

In the case of the latter system as disclosed in JP-A-2002-234192, it is conceivable to provide at the ink cartridge side with not only the antenna portion and the electronic part for the memory but also two sensor connection terminals.

The two sensor connection terminals are electrically connected to a sensor for detecting an amount of ink remaining in the inside of the ink cartridge.

The two sensor connection terminals are electrically connected to terminals of the electronic part of the memory via two connecting wire portions. However, if a distance between the two connecting wire portions is wide, noise of radio wave from a main body side of the ink jet type recording apparatus, or noise of radio wave of various apparatuses disposed outside of the ink jet type recording apparatus may be superposed onto a sensor signal transmitted through the two connecting wire portions.

Hence, it is still another object of the invention to resolve the above-described problem. Accordingly, yet another object of the invention is to provide an information communicating member capable of firmly providing a sensor signal by eliminating noise, such as an influence of radio wave from a main body to which a liquid container is mounted and an influence of radio wave from an apparatus other than the main body. A further object of the invention is to provide a liquid container having the information communicating member and a liquid ejecting apparatus to which the liquid container is mountable.

SUMMARY OF THE INVENTION

An information communicating member of the invention is to be disposed on a liquid container for supplying a liquid to a liquid ejecting head, and is featured by including an information storing portion storing therein information with regard to the liquid contained in the liquid container, and an antenna portion for communicating the information with regard to the liquid stored in the information storing portion between the information communicating member and a main body of a liquid ejecting apparatus in a wireless manner. The information communicating member further includes a base member for disposing the information storing portion and the antenna portion thereon, which base member is provided with an electric insulating property and an ultraviolet ray shielding property.

According to the invention, the information communicating member is disposed on the liquid container. The information storing portion of the information communicating member stores therein the information with regard to the liquid contained in the liquid container. The antenna portion communicates the information with regard to the liquid stored to the information storing portion between the information communicating member and the main body of the liquid ejecting apparatus by wireless communication.

The base member of the information communicating member disposes thereon the information communicating member and the antenna portion. The base member is provided with the electric insulating property and the ultraviolet ray shielding property.

Thereby, the electric insulating property of the base member can prevent electrostatic breakdown of the information storing portion and the antenna portion. Further, the ultraviolet ray shielding property of the base member shields ultraviolet ray and therefore, the information with regard to the liquid stored in the information storing portion can firmly be prevented from being erased (evaporated).

It is preferable that the above-described constitution is further featured in that the base member has a protecting layer having the electric insulating property and the ultraviolet ray shielding property for protecting the information storing portion and the antenna portion, and an adhering layer which adheres the information storing portion and the antenna portion with respect to the protecting layer and which attaches the information storing portion and the antenna portion to the liquid container along with the protecting layer.

According to the constitution, the protecting layer of the base member is a portion having the electric insulating property and the ultraviolet ray shielding property for protecting the information storing portion and the antenna portion. The adhering layer of the base member adheres the storing portion and the antenna portion with respect to the protecting layer and the adhering layer is a portion for attaching the information storing portion and the antenna portion to the liquid container, while protecting these portions from the liquid container.

Thereby, the information storing portion and the antenna portion can firmly be attached and fixed to the liquid container by the base member having a comparatively thin thickness.

It is preferable that the above-described constitution is further featured in that a jumper connecting line for electrically connecting the information storing portion and the antenna portion is arranged in the inside of the adhering layer.

According to the constitution, the jumper connecting line for electrically connecting the information storing portion and the antenna portion can be arrange in the inside of the adhering layer. Thereby, the jumper connecting line can be prevented from being brought into electric contact with the antenna portion.

It is preferable that the above-described constitution is further featured by having a peelable sheet which is removably attached with respect to the information storing portion and the antenna portion of the base member for covering and protecting the information storing portion and the antenna portion of the base member and which has the electric insulating property and the ultra violet ray shielding property.

According to the constitution, the peelable sheet is removably attached with respect to the information storing portion and the antenna portion of the base member for protecting the information storing portion and the antenna portion of the base member. By peeling the peelable sheet off from the base member side, the base member can be attached onto the liquid container along with the information storing portion and the antenna portion. The peelable sheet is provided with the electric insulating property and the ultraviolet ray shielding property and therefore, the electric insulating property of the peelable sheet can prevent electrostatic breakdown of the information storing portion and the antenna portion and the ultraviolet ray shielding property of the peelable sheet can firmly prevent the information with regard to the liquid stored in the information storing portion from being erased.

A liquid container having an information communicating member of the invention is adapted to supplying a liquid to a liquid ejecting head, and is featured by having an information communicating member. The information communicating member includes an information storing portion storing therein information with regard to the liquid contained in the liquid container, and an antenna portion for communicating information with regard to the liquid stored in the information storing portion to a main body of a liquid ejecting apparatus by a wireless communication. The information communicating member further includes a base member for disposing thereon the information storing portion and the antenna portion of the information communicating member, which base member is provided with an electric insulating property and an ultraviolet ray shielding property.

According to the invention, the information communicating member is disposed on the liquid container. The information storing portion of the information communicating member stores therein the information with regard to the liquid contained in the liquid container. The antenna portion communicates the information with regard to the liquid stored in the information storing portion between the antenna portion and the main body in a wireless manner.

The base member of the information communicating member disposes thereon the information communicating member and the antenna portion. The base member is provided with the electric insulating property and the ultraviolet ray shielding property.

Thereby, the electric insulating property of the base member can prevent electrostatic breakdown of the information storing portion and the antenna portion. Further, the ultraviolet ray shielding property of the base member shields ultraviolet ray and therefore, the information with regard to the liquid stored in the information storing portion can firmly be prevented from being erased (evaporated).

A liquid ejecting apparatus of the invention is featured by a liquid container including an information communicating member. The information communicating member includes an information storing portion storing therein information with regard to the liquid contained in the liquid container, and an antenna portion for communicating the information with regard to the liquid stored in the information storing portion between the information communicating member and a main body of the liquid ejecting apparatus by a wireless communication. The information communicating member further includes a base member for disposing thereon the information storing portion and the antenna portion of the information communicating member, which base member is provided with an electric insulating property and an ultraviolet ray shielding property.

According to the invention, the information communicating member is disposed on the liquid container. The information storing portion of the information communicating member stores therein the information with regard to the liquid contained in the liquid container. The antenna portion communicates the information with regard to the liquid stored in the information storing portion between the information communicating member and the main body of the liquid ejecting apparatus by the wireless communication.

The base member of the information communicating member disposes thereon the information communicating member and the antenna portion. The base member is provided with the electric insulating property and the ultraviolet ray shielding property.

Thereby, the electric insulating property of the base member can prevent electrostatic breakdown of the information storing portion and the antenna portion. Further, the ultraviolet ray shielding property of the base member shields ultraviolet ray and therefore, the information with regard to the liquid stored in the information storing portion can firmly be prevented from being erased (evaporated).

An information communicating member of the invention is to be disposed on a liquid container for supplying a liquid to a liquid ejecting head, and is featured by including an information storing portion storing therein information with regard to the liquid contained in the liquid container, and an antenna portion for communicating the information with regard to the liquid stored in the information storing portion between the information communicating member and a main body portion of a liquid ejecting apparatus by a wireless communication. The information communicating member further includes sensor terminal portions for electrically connecting a sensor for detecting a remaining amount of the liquid in the liquid container to the information storing portion, and a base member for disposing thereon the information storing portion, the antenna portion and the sensor terminal portions. The information communicating member further includes connecting wire portions for electrically connecting the sensor terminal portions to the information storing portion, which connecting wire portions are aligned in parallel with each other on the base member.

According to the invention, the information communicating member is disposed on the liquid container. The information storing portion of the information communicating member stores therein the information with regard to the liquid contained in the liquid container. The antenna portion is a portion for communicating the information with regard to the liquid stored in the information storing portion between the information communicating portion and the main body of the liquid ejecting apparatus by the wireless communication.

The sensor terminal portions electrically connect the sensor for detecting the remaining amount of the liquid in the liquid container to the information storing portion. The base member is a member for disposing thereon the information storing portion, the antenna portion and the sensor terminal portions.

The connecting wire portions electrically connect the sensor terminal portions to the information storing portion. The connecting wire portions are aligned in parallel with each other on the base member.

Thereby, since the connecting wire portions for electrically connecting the sensor terminal portions to the information storing portion are aligned in parallel with each other, the connecting wire portions are almost or completely free from an influence of radio wave of the main body on which the liquid container is mounted and/or an influence of ratio wave from an apparatus other than the main body.

Thereby, an accurate sensor signal which is not superposed with noise from the outside can be supplied from the sensor terminal portions to the side of the information storing portion.

It is preferable that the above-described constitution is further featured in that the connecting wire portions electrically connect the two sensor terminal portions to two terminals of the information storing portion, respectively, and the information with regard to the liquid and a power are transmitted and received.

According to the constitution, the connecting wire portions electrically connect the two sensor terminal portions to the two of the terminals of the information storing portion, respectively.

Thereby, the connecting wire portions can firmly transmit the sensor signal from the sensor terminal portion to the terminals of the information storing portion by preventing noise of radio wave of the outside from being superposed thereon. Further, the information with regard to ink and power can be transmitted and received.

It is preferable that the above-described constitution is further featured in that the base member has a protecting layer for protecting the information storing portion, the antenna portion, the sensor terminal portions and the connecting wire portions, and an adhering layer for attaching the information storing portion, the antenna portion, the sensor terminal portions and the connecting wire portions to the liquid container side of the protecting layer.

According to the constitution, the protecting layer of the base member is a member for protecting the information storing portion, the antenna portion, the sensor terminal portions and the connecting wire portions. The adhering layer is an adhering portion for attaching the information storing portion, the antenna portion, the sensor terminal portion and the connecting wire portions to the liquid container side of the protecting layer.

Thereby, although the base member is constructed by a simple constitution, the base member can firmly attach and fix the information storing portion, the antenna portion, the sensor terminal portions and the connecting wire portions to the container side, while protecting the information storing portion, the antenna portion, the sensor terminal portions and the connecting wire portions.

A liquid container of the invention is featured by having an information communicating member including an information storing portion storing therein information with regard to the liquid contained in the liquid container, and an antenna portion for communicating the information with regard to the liquid stored in the information storing portion between the information communicating member and a main body of a liquid ejecting apparatus by a wireless communication. The information communicating member further includes sensor terminal portions for connecting a sensor for detecting a remaining amount of the liquid in the liquid container to the information storing portion, and a base member for disposing thereon the information storing portion, the antenna portion and the sensor terminal portions. Connecting wire portions for electrically connecting the sensor terminal portions to the information storing portion are aligned in parallel with each other on the base member.

According to the invention, the information communicating member is disposed on the liquid container. The information storing portion of the information communicating member stores therein the information with regard to the liquid contained in the liquid container. The antenna portion is a portion for communicating the information with regard to the liquid stored in the information storing portion between the information communicating member and the main body of the liquid ejecting apparatus by the wireless communication.

The sensor terminal portions electrically connect the sensor for detecting the remaining amount of the ink in the liquid container to the information storing portion. The base member is a member for disposing thereon the information storing portion, an antenna portion and the sensor terminal portion.

The connecting wire portions electrically connect the sensor terminal portions to the information storing portion. The connecting wire portions are aligned in parallel with each other on the base member.

Thereby, since the connecting wire portions electrically connecting the sensor terminal portions to the information storing portion are aligned in parallel with each other, the connecting wire portion is almost or completely free from an influence of radio wave of the recording apparatus on which the liquid container is mounted and/or an influence of radio wave from an apparatus other than the recording apparatus.

Thereby, an accurate sensor signal which is not superposed with outside noise can be supplied from the sensor terminal portions to the information storing portion.

A liquid ejecting apparatus of the invention is featured by including a liquid container having an information communicating member. The information communicating member includes an information storing portion storing therein information with regard to the liquid contained in the liquid container, and an antenna portion for communicating the information with regard to the liquid stored in the information storing portion between the information communicating member and a main body of the liquid ejecting apparatus by a wireless communication. The information communicating member further includes sensor terminal portions for electrically connecting a sensor for detecting a remaining amount of the liquid in the liquid container to the information storing portion, and a base member for disposing thereon the information storing portion, the antenna portion and the sensor terminal portions. The information communicating member further includes connecting wire portions for electrically connecting the sensor terminal portions to the information storing portion, which connecting wire portions are aligned in parallel with each other on the base member.

According to the invention, the information communicating member is disposed on the liquid container. The information storing portion of the information communicating member stores therein information with regard to the liquid contained in the liquid container. The antenna portion is a portion for communicating the information with regard to the liquid stored in the information storing portion between the information communicating member and the main body of the liquid ejecting apparatus by the wireless communication.

The sensor terminal portions electrically connects the sensor for detecting the remaining amount of the liquid in the liquid container to the information storing portion. The base member is a member for disposing thereon the information storing portion, the antenna portion and the sensor terminal portions.

The connecting wire portions electrically connect the sensor terminal portions to the information storing portion. The connecting wire portions are aligned in parallel with each other on the base member.

Thereby, since the connecting wire portions electrically connecting the sensor terminal portions to the information storing portion are aligned in parallel with each other, the connecting wire portions is almost or completely free from an influence of radio wave from the recording apparatus on which the liquid container is mounted and/or an influence of radio wave from an apparatus other than the recording apparatus.

Thereby, an accurate sensor signal which is not superposed with outside noise can be supplied from the sensor terminal portions to the information storing portion.

The present disclosure relates to the subject matter contained in Japanese patent application Nos. 2003-115657 and 2003-115656 (both filed on Apr. 21, 2003), each of which is expressly incorporated herein by reference in its entirety.

DESCRIPTION OF THE PREFERRED EMBODIMENT

An explanation will be given of preferred embodiments of the invention in reference to the drawings as follows.

Figure 1:
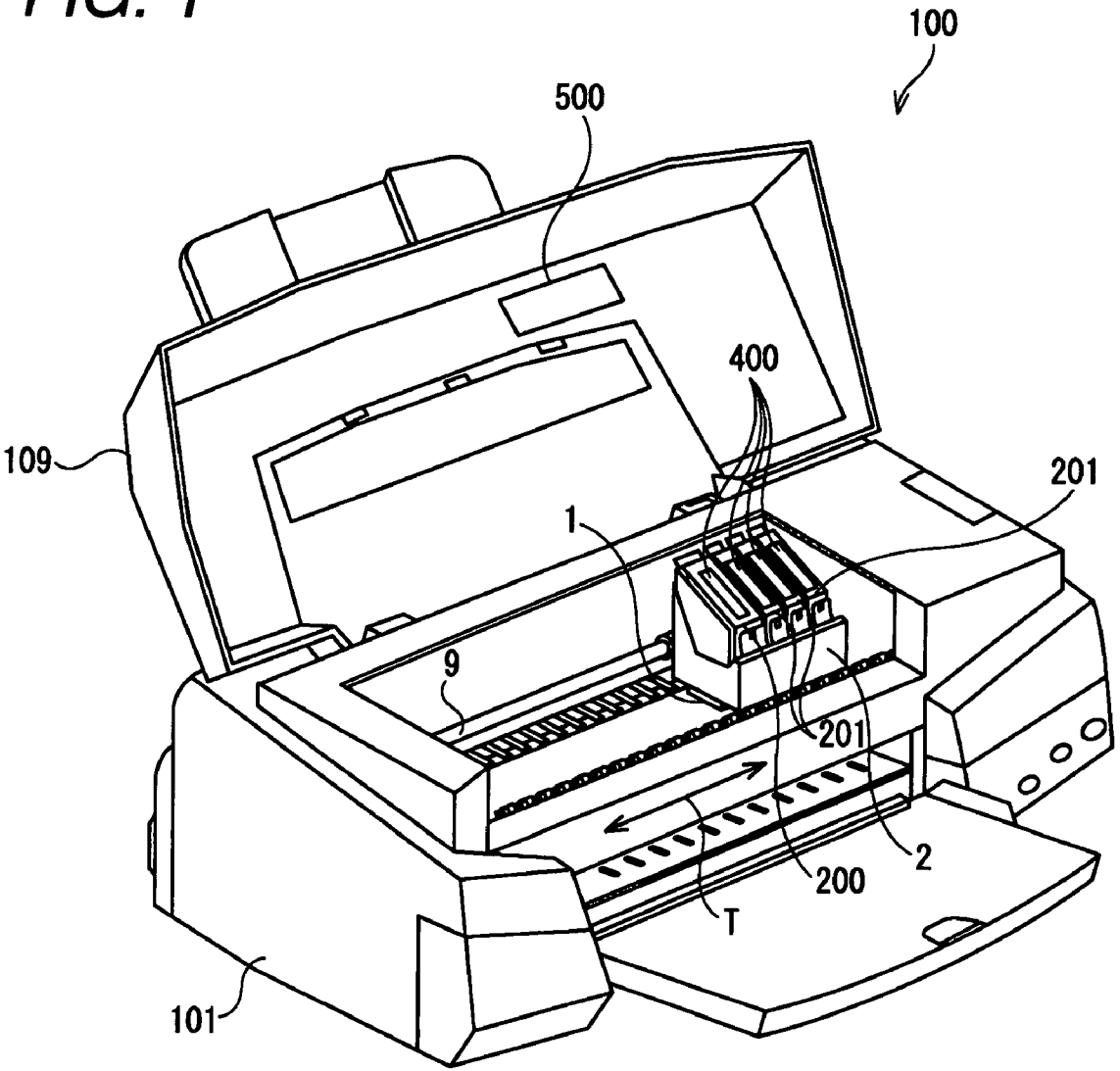
FIG. 1 is a perspective view showing an embodiment of an ink jet type recording apparatus as an example of a liquid ejecting apparatus of the invention.

FIG. 1 shows a preferred embodiment of an ink jet type recording apparatus as an example of a liquid ejecting apparatus, to which an ink cartridge as a liquid container having an information communicating member of the invention is mountable.

An ink jet type recording apparatus 100 shown in FIG. 1 includes a main body 101, a cover 109, a carriage 2, a recording head 1 and a plurality of ink cartridges 200, 201.

The ink jet type recording apparatus 100 shown in FIG. 1 is designed to print a record medium such as record sheet, and then discharge the same. The cover 109 is closable to cover the carriage 2 of the main body 101, the recording head 1 and the like.

The recording head 1 of the ink jet type is an example of a liquid ejecting head and is mounted to the carriage 2. The carriage 2 can reciprocally be moved along a T direction which is a width direction of record sheet, along with the recording head 1. Specifically, the recording head 1 prints the record medium when the carriage 2 is reciprocally moved along a guide bar 9 by operating a motor, not illustrated.

In this embodiment, a single one of the ink cartridge 200 and three other ones of the ink cartridges 201 are detachably mountable onto the carriage 2. Each of the ink cartridges 200, 201 is an example of a liquid container and ink is an example of a liquid.

Figure 2:
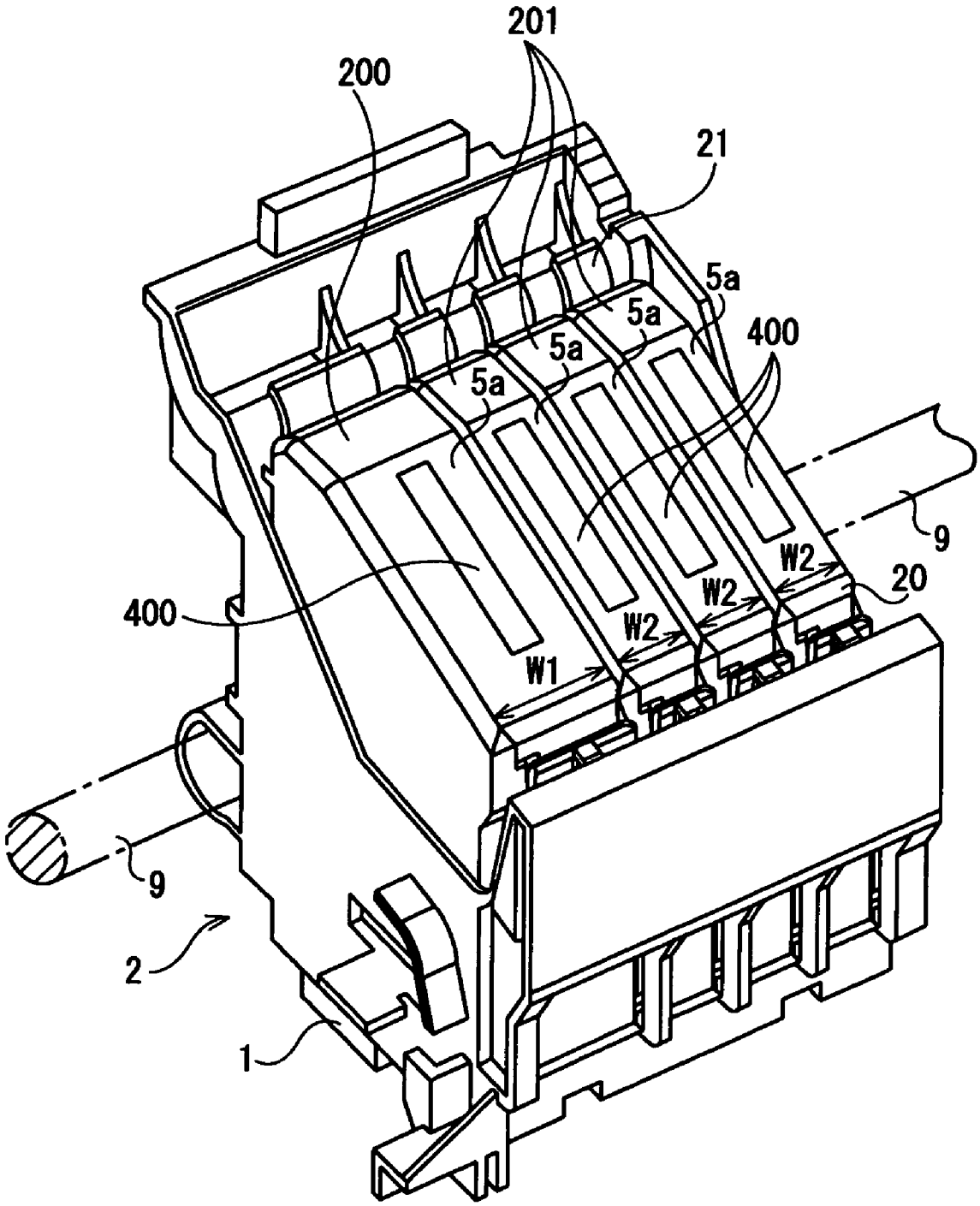
FIG. 2 is a perspective view showing a carriage of the ink jet type recording apparatus of FIG. 1, ink cartridges and information communicating members according to the present invention.

FIG. 2 shows the carriage 2 and the ink cartridges 200, 201 of FIG. 1 in an enlarged manner. The carriage 2 is made of, for example, plastic or metal.

The ink cartridge 200 and the ink cartridges 201 are made of, for example, plastic. The ink cartridge 200 is a cartridge containing, for example, black ink. In contrast thereto, the three ink cartridges 201 respectively contain inks of yellow, magenta and cyan.

Although an outer shape of the ink cartridge 200 shown in FIG. 2 is substantially similar to that of the cartridge 201, a width W1 of the ink cartridge 200 is made to be larger than a width W2 of the ink cartridge 201. A structure of the ink cartridge 200 is the same as a structure of the ink cartridge 201.

Figure 3:
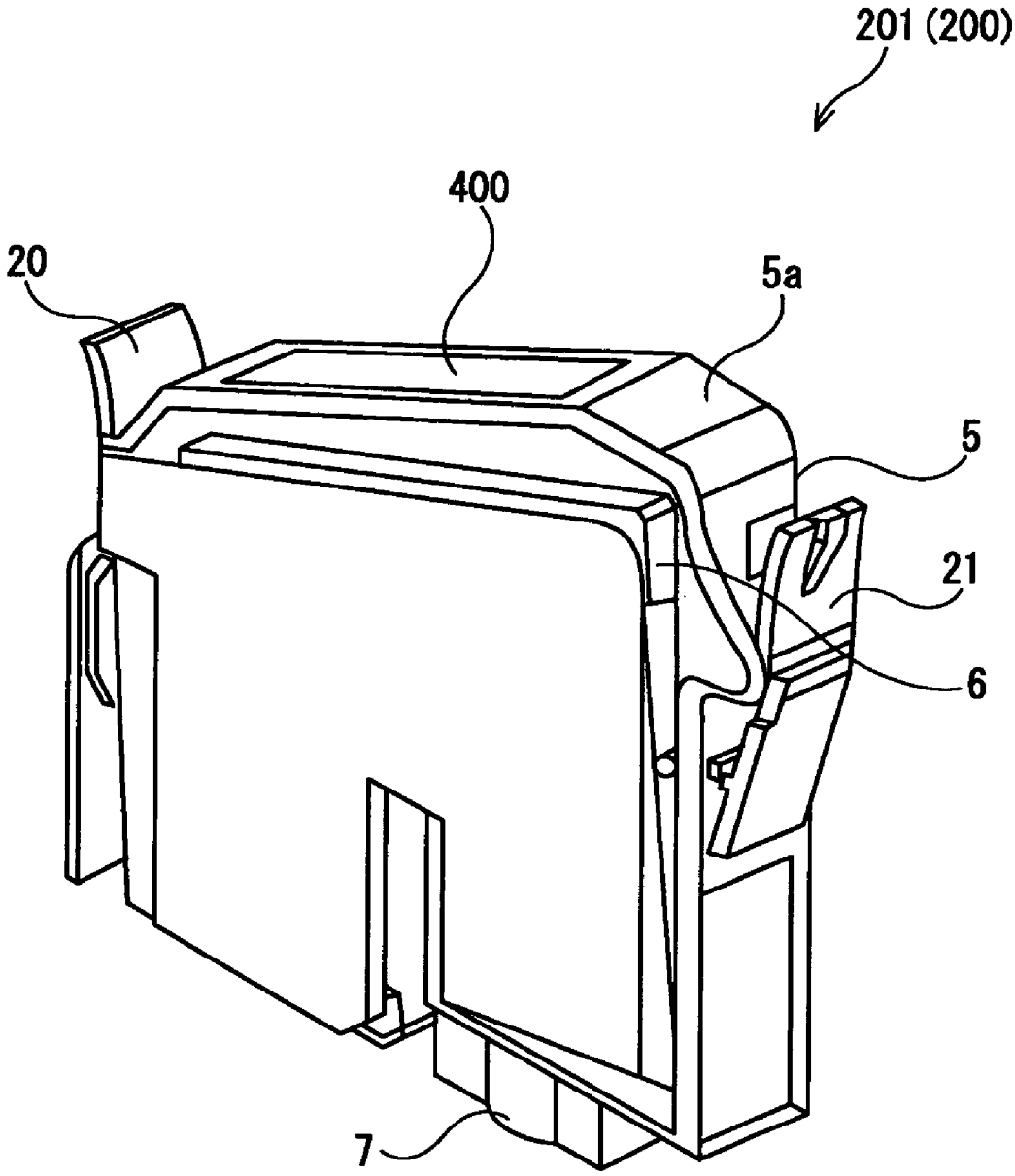
FIG. 3 is a perspective view of examples of the ink cartridge and the information communicating member according to the present invention as viewed from a rear side.
Figure 4:
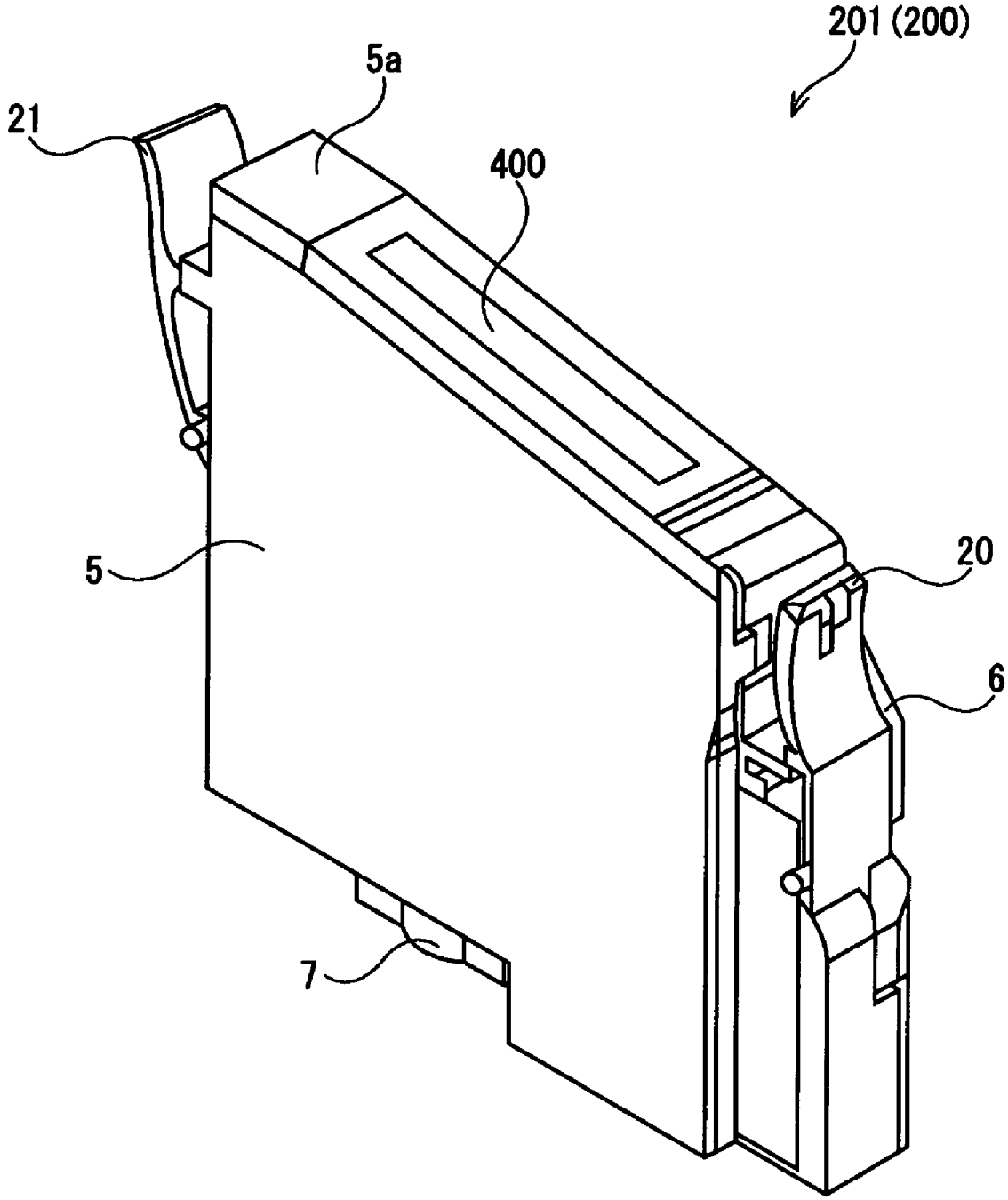
FIG. 4 is a perspective view of the examples of the ink cartridge and the information communicating member according to the present invention as viewed from a front side.

FIG. 3 and FIG. 4 representatively show the structure of the ink cartridge 201. The structure of the ink cartridge 201 shown in FIG. 3 and FIG. 4 is the same as the structure of the ink cartridge 200 shown in FIG. 2.

FIG. 3 is a perspective view showing the ink cartridge 201 as viewed from a rear side and FIG. 4 is a perspective view showing the ink cartridge 201 as viewed from a front side.

In FIG. 3 and FIG. 4, the ink cartridge 201 includes a flat container main body 5, levers 20, 21 and an ink supply port 7.

An information communicating member 400 according to a preferred embodiment of the invention is attached onto an upper wall face 5*a* of the container main body 5 of FIG. 3 and FIG. 4. The upper wall face 5*a* is a face inclined, for example, from the lever 20 to the lever 21. A lid member 6 is a lid for closing an opening portion of the container main body 5. An internal space between the container main body 5 and the lid member 6 is a space for containing ink.

The levers 20, 21 are levers operated in removing the ink cartridge 201 from inside of the carriage 2 shown in FIG. 2.

The information communicating member 400 shown in FIG. 3, FIG. 4 and FIG. 2 is a member for transmitting and receiving information with regard to ink, explained later, to and from the main body 101 side of the ink jet type recording apparatus 100 in a non-contact manner and for receiving operation power from the main body 101 side in a non-contact manner.

That is, transmission/reception of information with regard to ink and supply of electric power are conducted between the information communicating member 400 and the main body 101 side in a non-contact manner and by a wireless communicating system.

The recording head shown in FIG. 1 and FIG. 2 includes nozzle openings in correspondence with each of the ink cartridges. The recording head 1 conducts appropriate ink ejection from the respective nozzle openings by receiving information with regard to ink, such as a kind of ink contained in the inside of each of the ink cartridges 200 and 201 shown in FIG. 2, a remaining amount of ink, a serial number, and an effective period, from each of the ink cartridges 200, 201.

For that purpose, each of the ink cartridges 200, 201 includes the information communicating members 400 storing therein information with regard to ink.

As shown by FIG. 2 through FIG. 4, the information communicating member 400 is disposed on (preferably, removably attached onto) the upper wall face 5*a* of each of the ink cartridges 200, 201.

The information communicating member 400 is also referred to as an RFID (recognition by radio wave system, recognition in a non-contact manner) tag (baggage tag), an IC (Integrated Circuit) label or the like.

Figure 5:
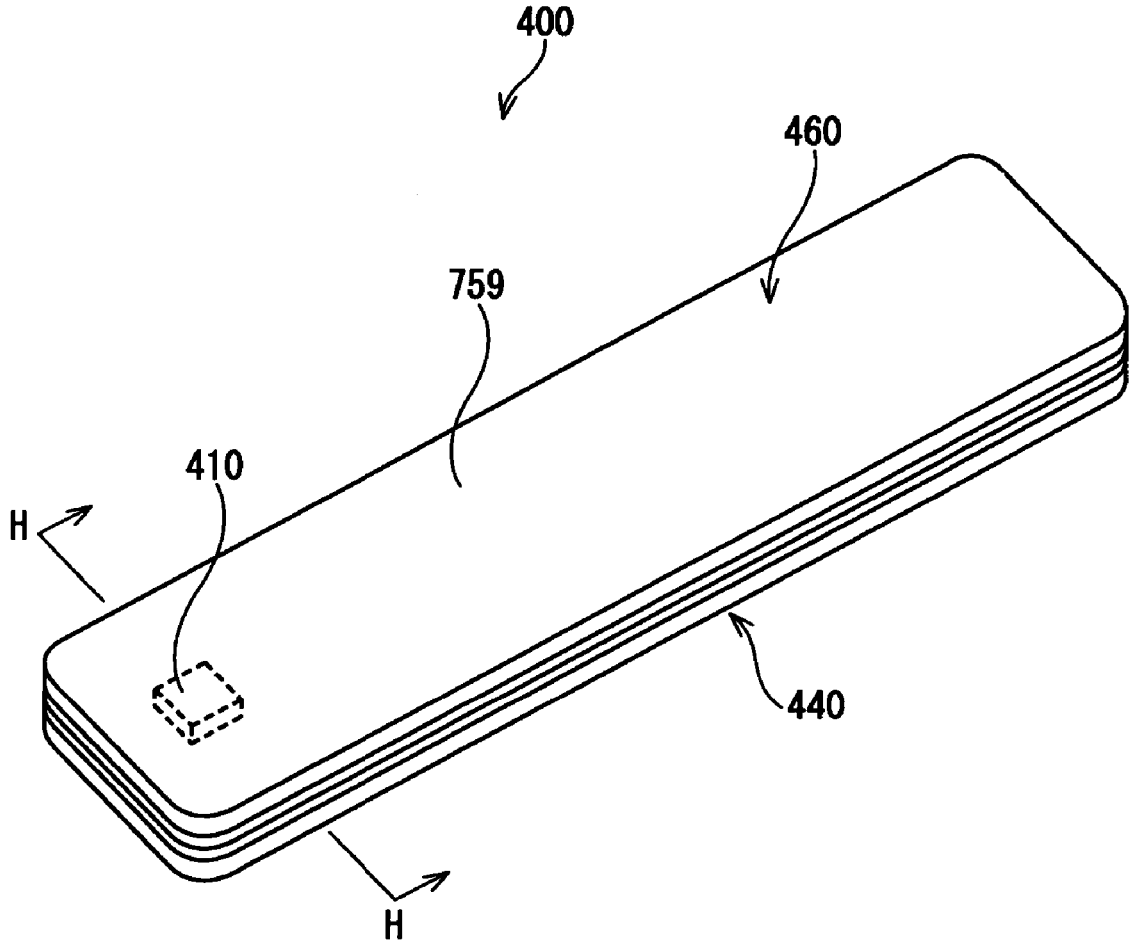
FIG. 5 is a perspective view of the information communicating member according to a first preferred embodiment of the present invention, showing a pre-use state of the information communicating member having an peelable sheet.
Figure 6:
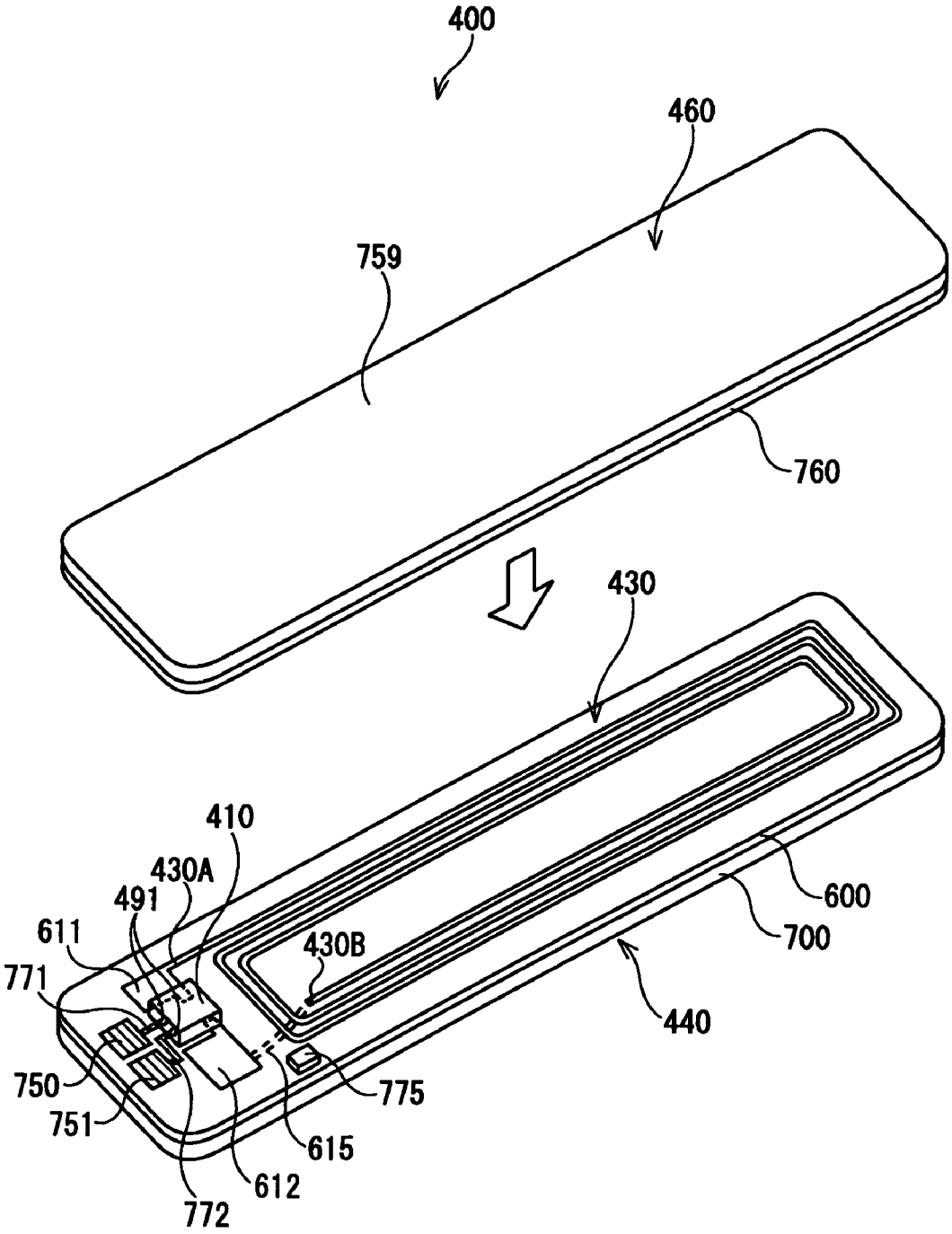
FIG. 6 is a disassembled perspective view of the information communicating member according to the first preferred embodiment.

FIG. 5 and FIG. 6 (FIG. 13 and FIG. 14) show a preferred first (second) embodiment of the information communicating member 400. The information communicating member 400 shown in FIG. 5 and FIG. 6 (FIG. 13 and FIG. 14) show a state before being attached onto the upper wall face 5*a* of the ink cartridge 200, 201 as shown by FIG. 2, that is, a state before use.

The information communicating member 400 of FIG. 5 and FIG. 6 (FIG. 13 and FIG. 14) is generally provided with a base member 440, a peelable sheet 460, an information storing portion 410, an antenna circuit portion (an example of antenna portion) 430, sensor terminal portions 750, 751, and connecting wire portions 771, 772.

The peelable sheet 460 is removably attached to the base member 440 for protecting the information storing portion 410 and the antenna circuit portion 430 of the base member 440. A peelable paper 759 of the peelable sheet 460 is a sheet peeled off from an adhering layer 760 shown in FIG. 7 (FIG. 15) along an peelable line 460R, and disposed of when the information communicating member 400 is attached onto the upper wall surface 5*a* of the ink cartridge 200, 201 as shown in FIG. 2.

Figure 7:
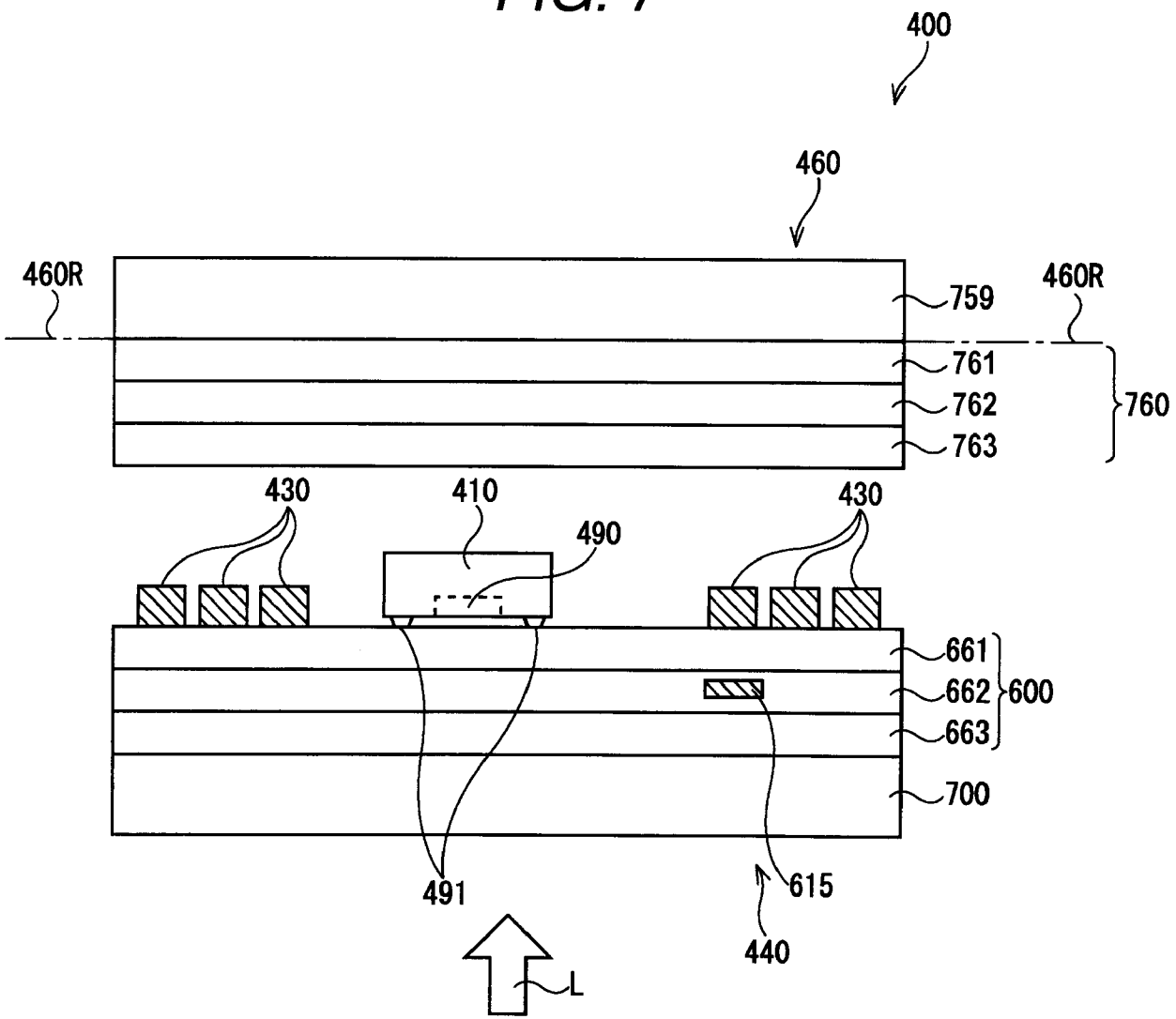
FIG. 7 is a view showing an example of a structure of a section of the information communicating member according to the first preferred embodiment, taken along a line H—H of FIG. 5.
Figure 13:
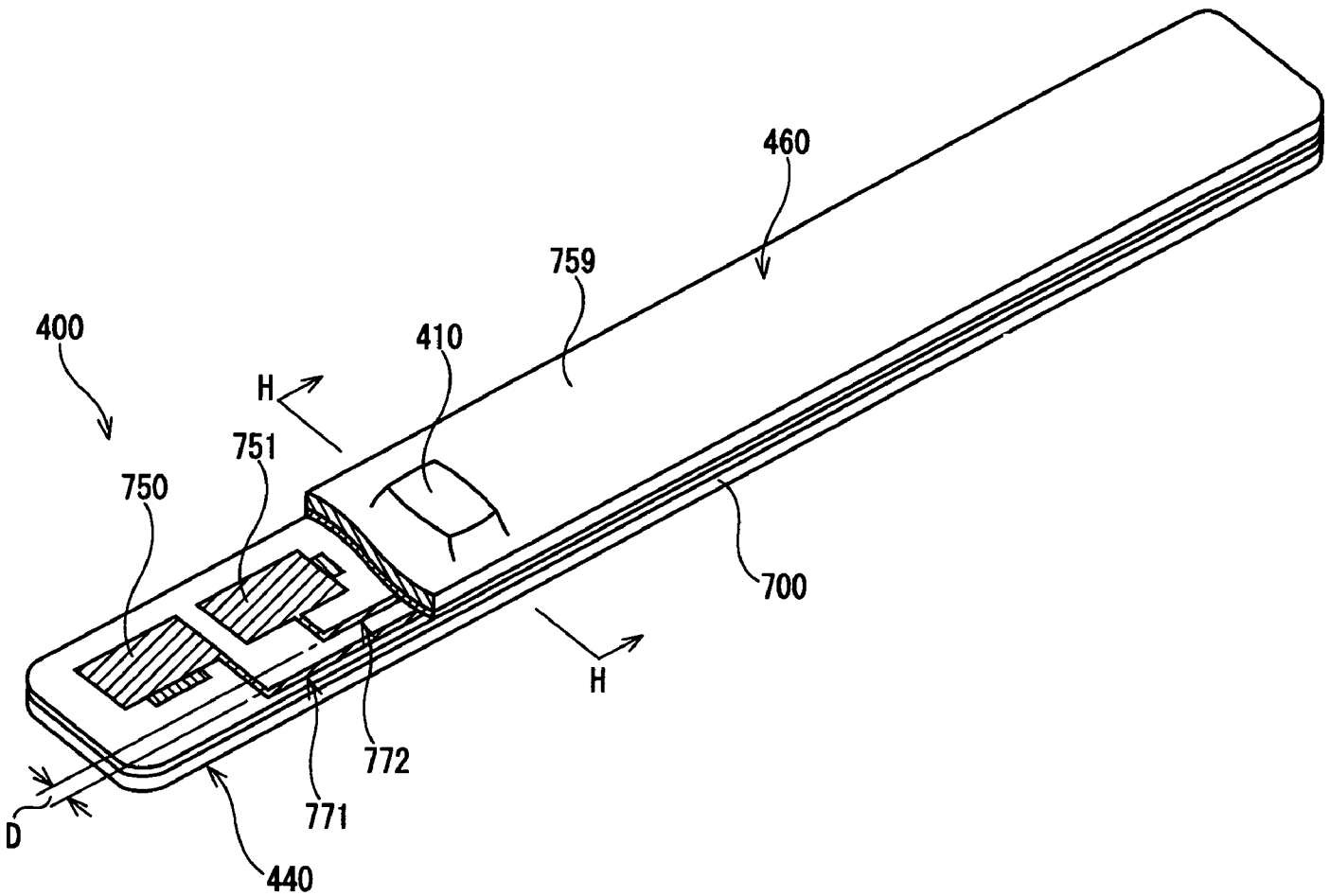
FIG. 13 is a perspective view showing the information communicating member according to a second preferred embodiment of the present invention.

FIG. 7 (FIG. 15) shows an example of a structure of a section taken along a line H—H of FIG. 5 (FIG. 13). However, in FIG. 7 (FIG. 15), the base member 440 and the peelable sheet 460 are illustrated to be sore or less separated from each other to illustrate to be easy to understand.

As shown by FIG. 5 through FIG. 7 (FIG. 13 through FIG. 15), the base member 440 and the peelable sheet 460 are strip-like members or members in an elongated rectangular shape. However, the shapes of the base member 440 and the peelable sheet 460 are not limited to the elongated rectangular shape or the strip-like shape but other shape of a circular shape, an elliptical shape, a polygonal shape or the like can be adopted in accordance with shape and use of the ink cartridge.

Figure 15:
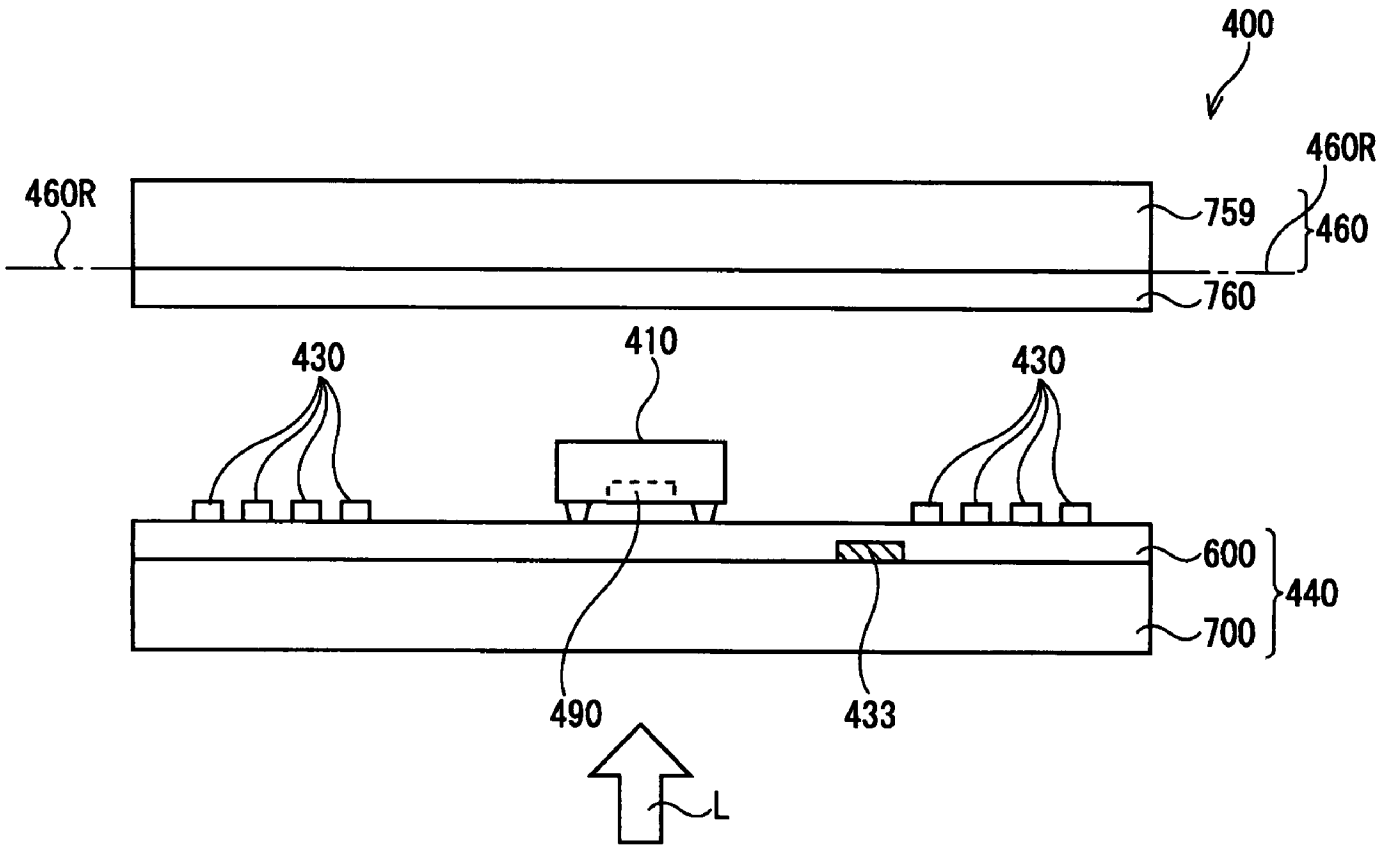
FIG. 15 is a view showing an example of a structure of a section taken along a line H—H of the information communicating member of FIG. 13.

The information storing portion 410 is an electronic part such as, for example, an IC package. The information storing portion 410 includes an non-volatile memory (EEPROM: Electrically Erasable Programmable Read Only Memory) 490 as shown by FIG. 7 (FIG. 15). The non-volatile memory 490 is stored with data information of, for example, a kind of ink contained in the ink cartridge 200, 201, a remaining amount of ink, a serial number, an effective period and the like.

The base member 440 of the information communicating member 400 is a member for wireless communication used in so-to-speak RFID which is a technology of recognition of a radio wave system or recognition in a non-contact type.

Next, a detailed explanation will be given of the first preferred embodiment of the information communicating member 400 shown in FIG. 5 through FIG. 7.

FIG. 5 shows an example before using the information communicating member 400 and FIG. 6 is a disassembled perspective view of the information communicating member 400 of FIG. 5.

As shown by FIG. 5 and FIG. 6, the information communicating member 400 is a comparatively thin member in a rectangular shape or in a strip-like shape.

The information communicating member 400 includes the peelable sheet 460, the base member 440, the information storing portion 410 and the antenna circuit portion 430. The antenna circuit portion 430 is constituted by forming a conductor helically by a predetermined number of times and is also referred to as an antenna pattern portion or an antenna portion.

In a state before attaching the base member 440 for use, the peelable sheet 460 shown in FIG. 5 and FIG. 6 is used. The peelable sheet 759 of the peelable sheet 460 is a sheet which is previously attached to the base member 440 side for protecting the information storing portion 410, the antenna circuit portion 430 and the sensor terminal portions 750, 751 of the base member 440 and which is capable of being simply peeled off from the adhering layer 760 along the peelable line 460R shown in FIG. 7 when the information communicating member 400 is used.

As shown by FIG. 6, the information storing portion 410 and the antenna circuit portion 430 are formed on an adhering layer 600 side of the base member 440.

The information storing portion 410 of FIG. 6 is electrically connected to wiring portions 611, 612 of FIG. 6 by a so-to-speak face-down style. That is, as shown by FIG. 7, the information storing portion 410 includes the non-volatile memory 490 and the non-volatile memory 490 is electrically connected to the wiring portions 611, 612 by using bumps 491, 491 as shown in FIG. 6.

The sensor terminal portions 750, 751, the connecting wire portions 771, 772, the wiring portions 611, 612 and the antenna circuit portion 430 are formed by a metal having a conductivity, for example, copper (Cu).

The wiring portion 611 on one side shown in FIG. 6 is electrically connected to one end portion 430A of the antenna circuit portion 430. The wiring portion 612 on other side is electrically connected to other end portion 430B of the antenna circuit portion 430 via a jumper connecting line 615.

The jumper connecting line 615 passes through the inside of the adhering layer 600 as shown by, for example, FIG. 7 in order that the jumper connecting line 615 is prevented from being electrically connected to the antenna circuit portion 430. Thereby, the jumper connecting line 615 is not brought into electric contact with the antenna circuit portion 430 and the jumper connecting line 615 can be protected electrically and mechanically by the adhering layer 600.

As shown by FIG. 6, the antenna circuit portion 430 is formed helically.

The non-volatile memory 490 of the information storing portion 410 shown in FIG. 7 is a memory (EEPROM) in which information is rewritable electrically.

The non-volatile memory 490 stores therein information with regard to ink, such as a kind of ink sealed in the inside of the ink cartridge 200, a remaining amount of ink, a serial number, an effective period and the like.

Next, an explanation will be given of an example of a laminated layer structure of the base member 440 and a laminated layer structure of the peelable sheet 460.

First, an explanation will be given of the laminated layer structure of the base member 440.

The base member 440 shown in FIG. 7 is a member laminated with a protecting layer 700 and the adhering layer 600. The protecting layer 700 is, for example, polypropylene resin layer and is provided with two characteristics of an electric insulating property and an ultraviolet ray shielding property.

Therefore, the protecting layer 700 shields ultraviolet ray L radiated from the outside such that the ultraviolet ray L does not affect on the non-volatile memory 490 of the information storing portion 410 and information with regard to ink stored in the non-volatile memory 490 is not evaporated (erased) by influence of the ultraviolet ray L.

As a material of the protecting layer 700, there can be adopted, for example, "Yupo" which is a trade name of Yupo Corporation (a merger of Mitsubishi Kagaku K. K. and Ouji Seishi K. K.). The material of the protecting layer 700 is a synthesized paper added with calcium carbonate as a filler to polypropylene resin (major component). This synthesized paper is a while transparent film and therefore, a rate of shielding ultraviolet ray is high.

The adhering layer 600 is a member laminated with a polyester group adhering agent layer 661, a polyester resin layer 662 and an acrylic group adhering agent layer 663, for example, in the example of FIG. 7.

In contrast thereto, the peelable sheet 460 shown in FIG. 7 includes the peelable paper 759.

Figure 9:
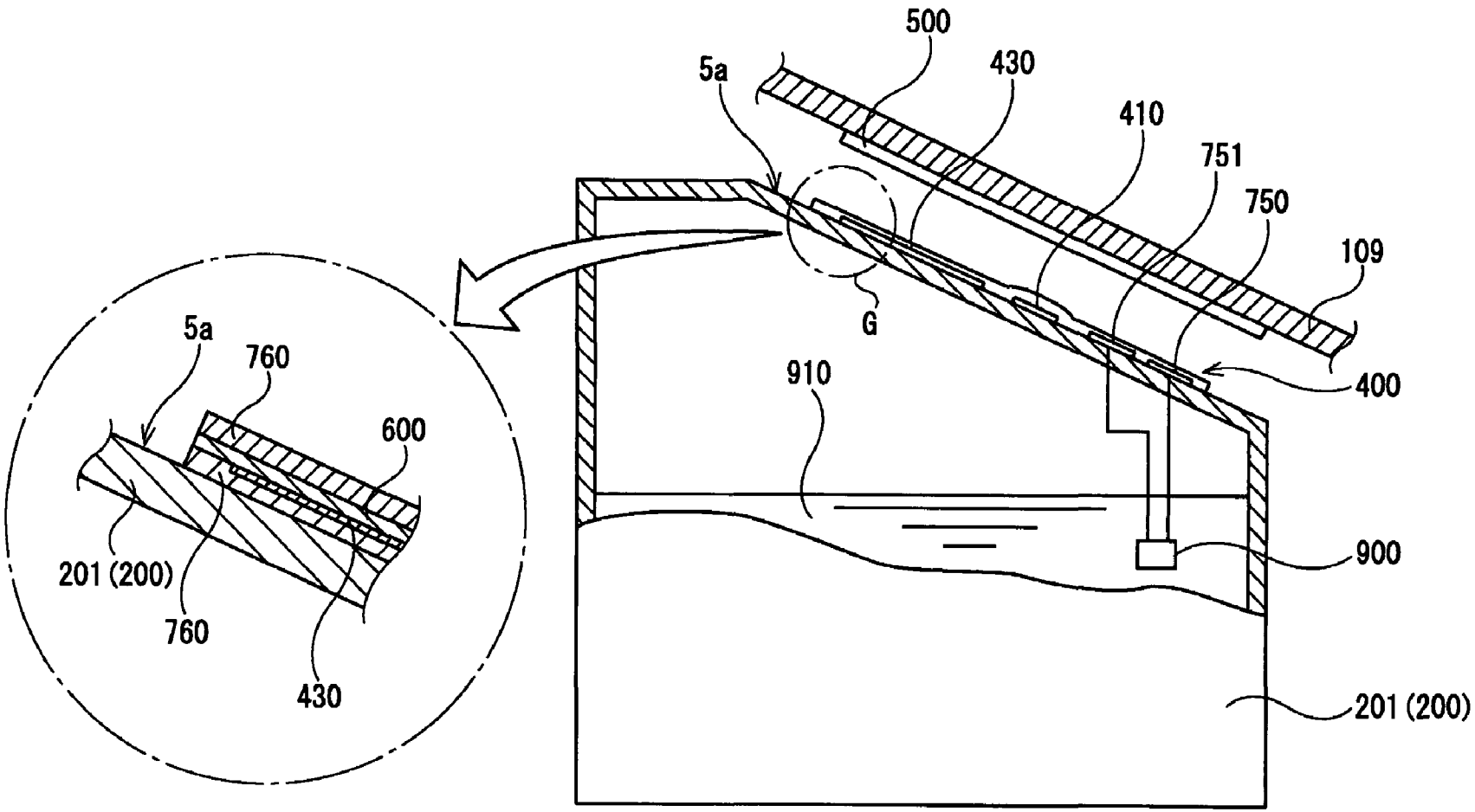
FIG. 9 is a partially sectional view showing the ink cartridge, an antenna board and the information communicating member according to the present invention.

In a pre-use state in which the adhering layer 760 of the peelable sheet 460 is laminated on the adhering layer 600 of the base member 440 as shown by FIG. 5, the peelable sheet 460 is partially peeled off for actual use so that the information communicating member 400 is adhered onto the upper wall face 5*a* as shown by FIG. 9. That is, the adhering layer 760 of the peelable sheet 460 shown in FIG. 7 is separated from the peelable paper 759 along the peelable line 460R to be exposed to the outside.

This way, the adhering layer 760 is exposed to the outside, while maintaining a state in which the adhering layer 760 is laminated on the adhering layer 600 to cover components mounted on the adhering layer 600, i.e. the information storing portion 410, the antenna circuit portion 430, 600, the connecting wire portions 771, 772, the sensor terminal portions 750, 751 and the wiring portions 611, 612 shown in FIGS. 6 and 7. The adhering layer 760 is adhered onto the upper wall face 5*a*, while maintaining a state in which two of the adhering layers 600, 760 are laminated one on another as shown by, for example, a portion G of FIG. 9 and FIG. 10.

Therefore, the information communicating member 400 can firmly be attached onto the upper wall face 5*a* by being brought into close contact therewith by using the adhering layer 760.

The peelable paper 759 can use a material similar to, for example, the protecting layer 700. That is, the peelable paper 759 is provided with an electric insulating property and an ultraviolet ray shielding property. The adhering layer 760 is constituted by an acrylic group adhering agent layer 761, a polyester resin layer 762, and an acrylic group adhering agent layer 763.

Both of the protecting layer 700 and the peelable paper 759 are provided with the electric insulating property and the ultraviolet ray shielding property.

As a material of the protecting layer 700 and peelable paper 759, for example, the following material can be adopted other than the above-described material.

A material having an ultraviolet ray shielding property can be mixed to a PET (polyethyleneterephthalate) material.

Further, in order to provide an ultraviolet ray shielding property and an electric insulating property to PET, PET may be mixed with, for example, titanium oxide, zinc oxide, selenium oxide, benzotriazole (organic substance) or the like having an ultraviolet ray shielding property.

In place of PET, an adhering material can be kneaded with the above-described material having the ultraviolet ray shielding property.

Further, as a material having an electric insulating property and an ultraviolet ray shielding property, foamed PET can be adopted. The foamed PET increases the ultraviolet ray shielding property by reducing transmittance of ultraviolet ray by foaming PET and looks in white color.

Although a material preferably having both of an electric insulating property and an ultraviolet ray shielding property can be adopted for the adhering layer 600 and the adhering layer 760 shown in FIG. 7, the material may be provided with only the electric insulating property.

As shown by FIG. 6 and FIG. 7, the information storing portion 410 is electrically connected to the wiring portions 611, 612 shown in FIG. 6 on the adhering layer 600 side in the so-to-speak face-down state. Therefore, the non-volatile memory 490 of the information storing portion 410 is disposed on the base member 440 in the so-to-speak face-down state. This way, the non-volatile memory 490 is not directly exposed to the outside and is protected by the protecting layer 700 and the adhering layer 600. By providing at least the protecting layer 700 with, for example, the ultraviolet ray shielding property, the stored information of the non-volatile memory 490 can be protected from being erased by the influence of the ultraviolet ray L radiated from the outside.

That is, since the protecting layer 700 is provided with a function of shielding the ultraviolet ray L radiated from the outside, the function of the protecting layer 700 and, preferably, an additional function of the adhering layer 600 having the ultraviolet ray shielding property can firmly protect information with regard to ink stored in the non-volatile memory 490.

Figure 10:
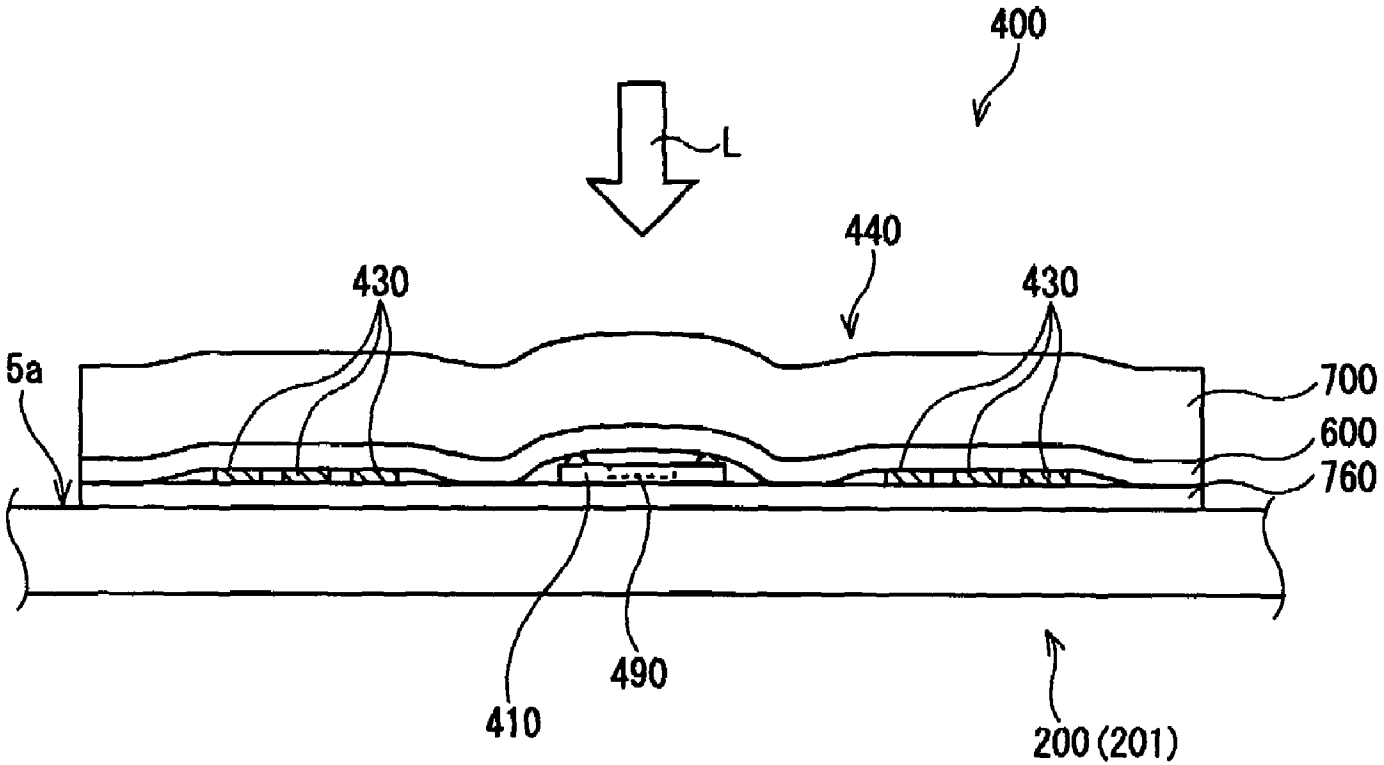
FIG. 10 is a view showing an example of a use state in which the information communicating member according to the present invention is attached onto the ink cartridge.

As shown by FIG. 10, the information storing portion 410 and the antenna circuit portion 430 are completely covered by the protecting layer 700 and the adhering layer 600 both having the electric insulating property and therefore, static electricity generated by the human body or static electricity generated by a mechanical portion of the ink jet type recording apparatus do not give an influence thereon. Therefore, the non-volatile memory 490 of the information storing portion 410 and the antenna circuit portion 430 are free from a concern of electrostatic breakdown.

Further, the sensor terminal portions 750, 751 can be protected by the protecting layer 700 and the adhering layer 600 of the base member 440. Therefore, the sensor terminal portions 750, 751 are not subjected to electrostatic breakdown by static electricity from the outside.

As shown by FIG. 7, the jumper connecting line 615 can be arranged by, for example, being embedded in the adhering layer 600. The jumper connecting line 615 is protected by the protecting layer 700 and the adhering layer 600 and therefore, the jumper connecting line 615 can also be protected against electrostatic breakdown. That is, although when static electricity is jumped to the jumper connecting line 615, the information storing portion 410 is subjected to electrostatic breakdown, such an incidence is not brought about at all.

As shown by FIG. 7, the information storing portion 410 is fixed to the adhering layer 600 in the so-to-speak face-down state. Therefore, the non-volatile memory 490 can firmly be shielded from static electricity and ultraviolet ray by the adhering layer 600 and the protecting layer 700. That is, in the use state in which the base member 440 has been attached to the upper wall face 5*a* as shown by FIG. 10, the non-volatile memory 490 is not exposed to the outside and is completely covered by the adhering layer 600 and the protecting layer 700.

As described above, as materials of the protecting layer 700, the peelable paper 759 or the like, other kind of material, such as PS (polystyrene) can also be adopted in place of PET.

In the information communicating member 400 of the embodiment of FIG. 7, the adhering layer 600 of the base member 440 is formed by a plurality of the layers. Similarly, the adhering layer 760 of the peelable sheet 460 is formed by a plurality of the layers.

Figure 12:
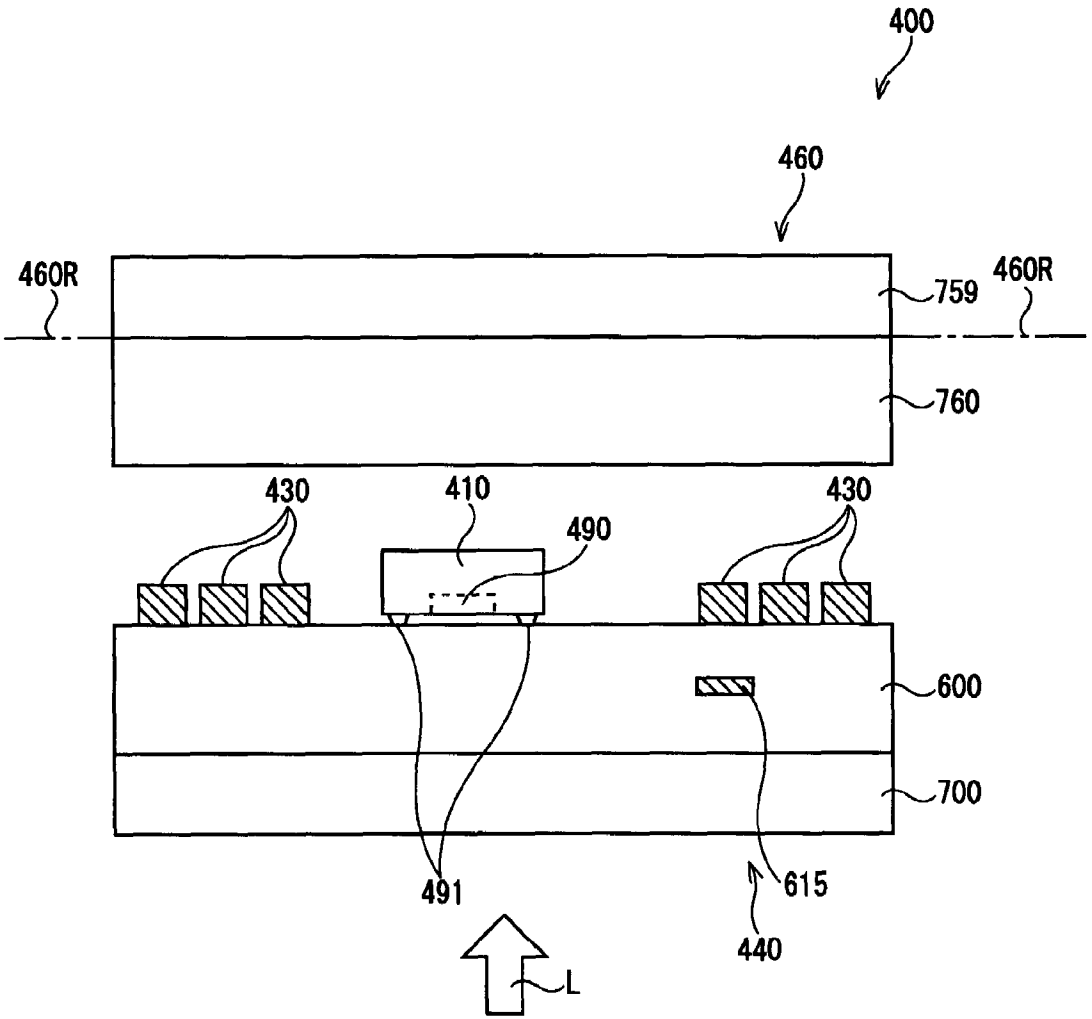
FIG. 12 is a sectional view showing the information communicating member according to a modification of the first preferred embodiment.

However, the invention is not limited thereto. As shown, for example, in FIG. 12 illustrating a modification of the first preferred embodiment, the adhering layer 600 can be constituted by a single layer and similarly, the adhering layer 760 can be constituted by a single layer.

In this case, for example, a polyester group adhering agent can be used for the single layer of the adhering layer 600 and, for example, an acrylic group adhering agent can be used for the single layer of the adhering layer 760.

When such a structure is constructed, the laminated layer structure of the information communicating member can be simplified and a reduction in cost can be achieved.

According to the invention, the electric insulating property of the base member can protect the information storing portion and the antenna portion against electrostatic breakdown. Further, the ultraviolet ray shielding property of the base member can firmly protect information with regard to ink stored in the information storing portion from being erased (evaporated).

Thereby, the information storing portion and the antenna portion can firmly be attached and fixed to the ink cartridge using the base member having the comparatively thin thickness. The jumper connecting line can be prevented from being brought into electric contact with the antenna portion.

Referring to FIGS. 13 to 17, preferred second embodiment of the information communicating member 400 will be discussed in detail.

Figure 16:
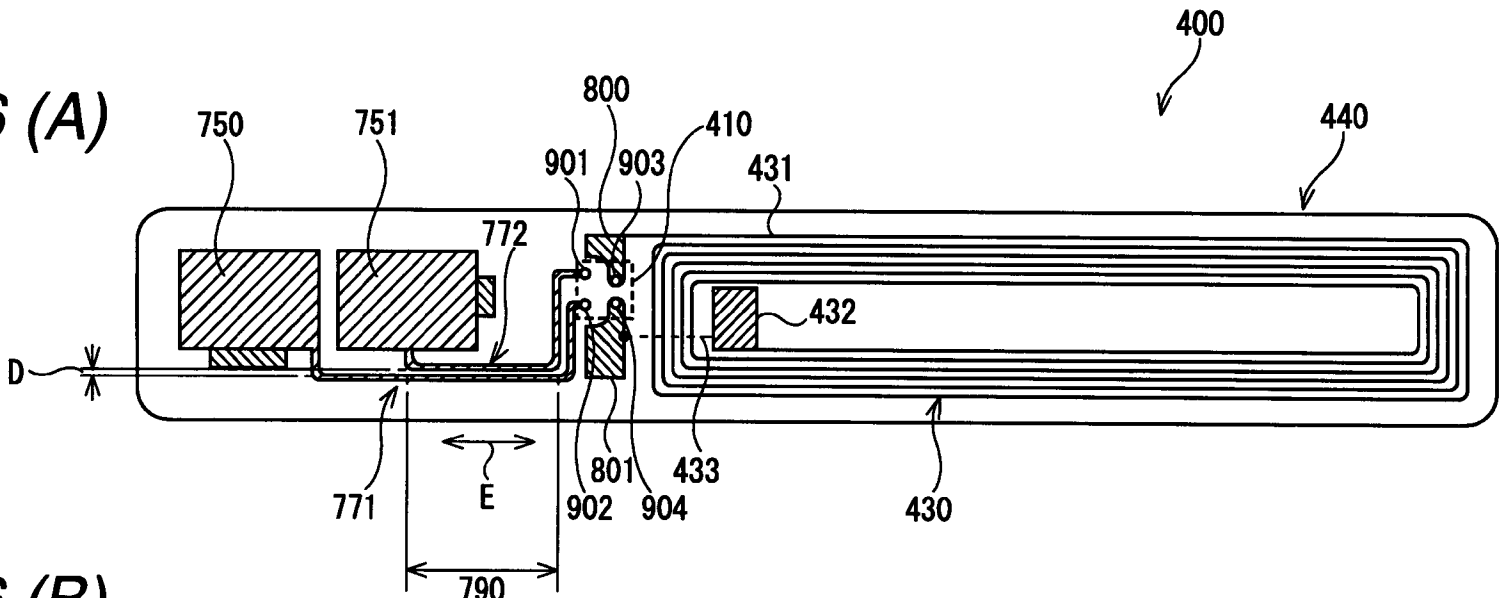
FIGS. 16(A) and 16(B) is a view showing sensor terminal portions, connecting wire portions, an information storing portion, an antenna circuit portion and the like of the information communicating member according to the second preferred embodiment.
Figure 16:
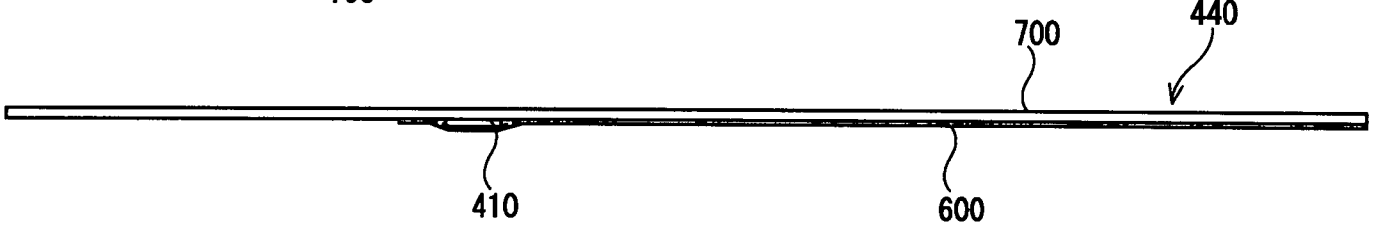

As shown by FIG. 15 and FIG. 16, the base member 440 is a laminated layer structure of, for example, a protecting layer 700 and the adhering layer 600.

The protecting layer 700 is a member in a strip-like shape or an elongated rectangular shape. An inner face side of the protecting layer 700 is formed with the adhering layer 600. As a material of the protecting layer 700, for example, a plastic resin can be used. It is preferable that the protecting layer 700 is provided with an ultraviolet ray shielding property capable of shielding ultraviolet ray L from the outside and also with an electric insulating property.

The adhering layer 600 of FIG. 15 fixes thereon the information storing portion 410 and an antenna circuit portion 430 at predetermined positions.

The peelable sheet 460 is a member in an elongated rectangular shape or a strip-like shape. The peelable sheet 460 is the same as the peelable paper 759. It is preferable that the peelable paper 759 is made of a material having, for example, an ultraviolet ray shielding property and having an electric insulating property similar to the protecting layer 700.

In a pre-use state in which the adhering layer 760 brought into contact with the peelable sheet 460 is laminated on the adhering layer 600 of the base member 440 as shown by FIG. 13, the peelable sheet 460 is peeled off for actual use so that the information communicating member is attached onto the upper wall face 5*a* as shown by FIG. 9. This way, the adhering layer 760 brought into contact with the peelable sheet 460 shown in FIG. 15 is separated from the peelable paper 759 along the peelable line 460R to be exposed to the outside.

Figure 14:
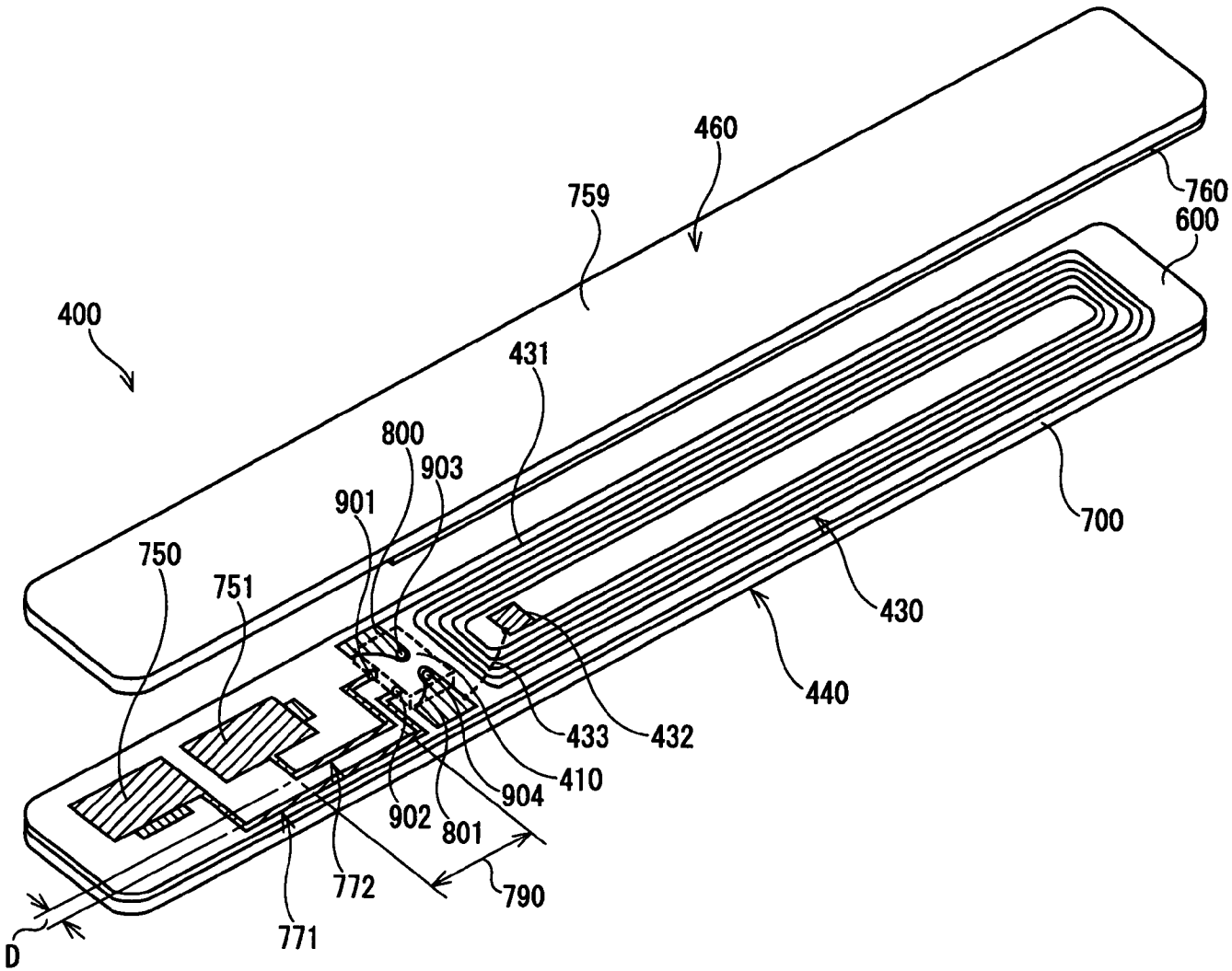
FIG. 14 is a disassembled perspective view showing a base member and a peelable sheet of the information communicating member shown in FIG. 13.

Accordingly, the adhering layer 760 is exposed to the outside, while maintaining a state in which the adhering layer 760 is laminated to the adhering layer 600 to cover components mounted on the adhering layer 600, i.e. the information storing portion 410, the antenna circuit portion 430 and terminal portions 800, 801 shown in FIG. 14. As shown, for example, at a portion G of FIG. 9, the adhering layer 760 is attached onto the upper wall face 5*a* in the state in which two of the adhering layers 600, 760 are laminated one on another.

Therefore, the information communicating member 400 can firmly be attached onto and closely contacted with the upper wall face 5*a* by using the adhering layer 760.

As shown by FIG. 15, the information storing portion 410 is electrically connected to the terminal portions 800, 801 shown in FIG. 14 on the adhering layer 600 side in a so-to-speak face-down state. Therefore, the non-volatile memory 490 of the information storing portion 410 is disposed on the base member 440 in the so-to-speak face-down state. Accordingly, the non-volatile memory 490 is not directly exposed to the outside and is protected by the protecting layer 700 and the adhering layer 600. Since the protecting layer 700 is provided with, for example, an ultraviolet ray shielding property, the stored information of the non-volatile memory 490 can be prevented from being erased by influence of the ultraviolet ray L radiated from the outside.

The information storing portion 410 is provided with projected electrodes 901, 902, 903, 904 such as bumps.

As shown by FIG. 16(A), the information storing portion 410 is held in the face-down state and the projected electrodes 903, 904 are respectively connected electrically to the terminal portions 800, 801.

Next, an explanation will be given of the antenna circuit portion 430 in reference to FIG. 16 and FIG. 14.

The antenna circuit portion 430 is an antenna provided by forming a conductor in a helical shape by a predetermined number of times. One end portion 431 of the antenna circuit portion 430 is electrically connected to the terminal portion 800. Other end portion 432 of the antenna circuit portion 430 is electrically connected to the terminal portion 801 via a jumper connecting line 433.

This way, the one end portion 431 and the other end portion 432 of the antenna circuit portion 430 are electrically connected to the projected electrodes 903, 904 of the information storing portion 410.

Meanwhile, the projected electrodes 901, 902 shown in FIG. 16 and FIG. 14 are connected to the sensor terminal portions 750, 751 via the connecting wire portions 771, 772.

As shown by FIG. 14 and FIG. 16, each of the sensor terminal portions 750, 751 has, for example, a rectangular shape. The connecting wire portion 771 electrically connects the sensor terminal portion 750 and the projected electrode 902. The connecting wire portion 772 electrically connects the sensor terminal portion 751 and the projected electrode 901.

What is particularly important here is that the connecting wire portions 771, 772 are formed in parallel with each other and with a small clearance therebetween. That is, the sensor terminal portions 771 and 772 are formed in parallel with each other along an E direction, that is, a longitudinal direction of the base member 440 and a small clearance D is formed therebetween. Boldness of each of the connecting wire portions 771, 772 is, for example, 0.2 mm and the clearance D between the connecting wire portions 771, 772, that is, a wiring pitch thereof is, for example, 0.2 mm through 0.6 mm. This way, the connecting wire portions 771, 772 are provided with a parallel wire section portion 792.

The sensor terminal portions 750, 751, the connecting wire portions 771, 772, the terminal portions 800, 801, and the antenna circuit portion 430 as mentioned above are formed on the same face of the base member 440.

As shown by FIG. 16, the jumper connecting line 433 is passed through the inside of the adhering layer 600 as shown by, for example, FIG. 15. The jumper connecting line 433 and the antenna circuit portion 430 are not brought into electric contact with each other and the jumper connecting line 433 can firmly connect electrically the other end portion 432 of the antenna circuit portion 430 and the terminal portion 801 as shown by FIG. 16. Further, when such a structure is adopted, the jumper connecting line 433 is not exposed to the outside and therefore, the jumper connecting line 433 can be protected by the adhering layer 600.

The sensor terminal portions 750, 751, the connecting wire portions 771, 772, the terminal portions 800, 801, and the antenna circuit portion 430 are formed by a metal having a conductivity, for example, copper (Cu).

Meanwhile, as shown by FIG. 14 and FIG. 16, the two connecting wire portions 771, 772 electrically connect the sensor terminal portions 750, 751 and the projected electrodes 901, 902, respectively. The connecting state is featured in that, as has already been described, the two connecting wire portions 771, 772 are formed in parallel with each other and with the clearance therebetween as reduced as possible.

Figure 17:
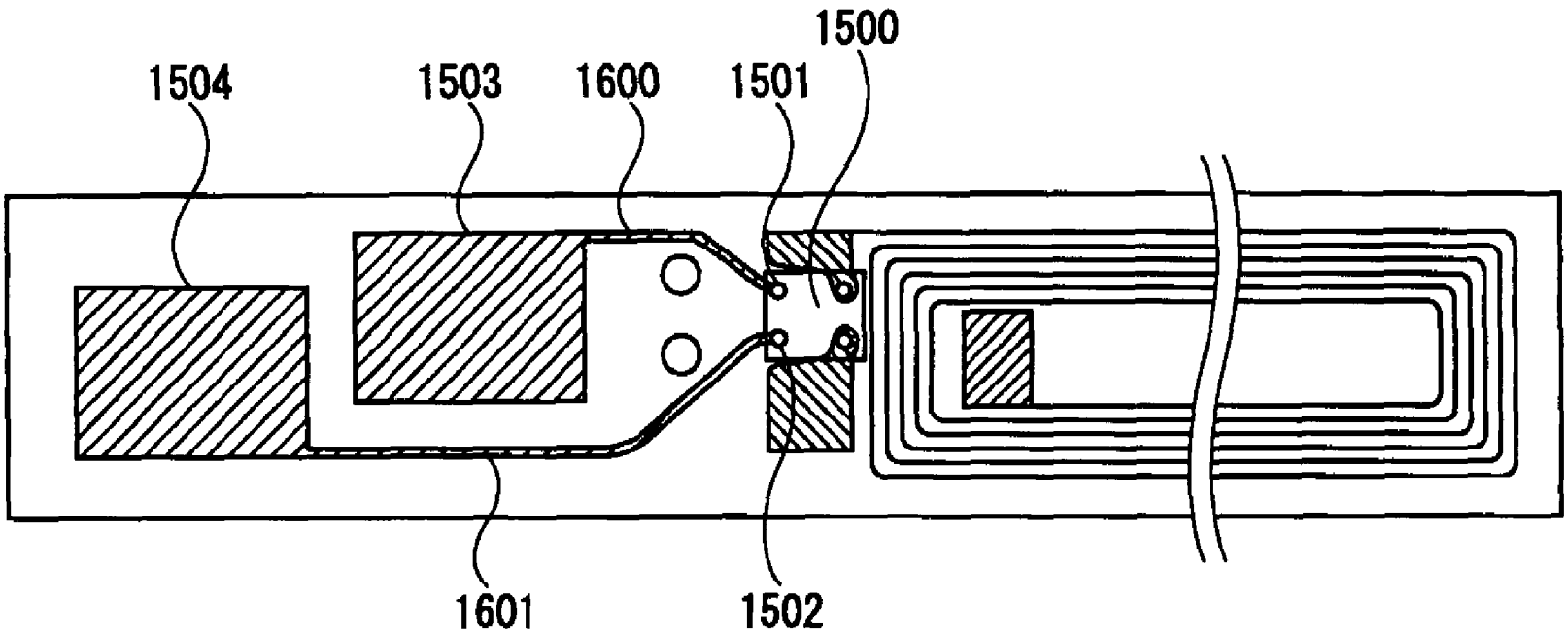
FIG. 17 is a view showing a comparative example different from the information communicating member of the invention.

In contrast thereto, FIG. 17 shows a comparative example different from the information communicating member of the invention for reference.

According to an information communicating member of the comparative example, projected electrodes 1501, 1502 of an information storing portion 1500 are respectively connected electrically to sensor terminal portions 1503, 1504 by wiring portions 1600, 1601. However, the wiring portions 1600, 1601 are separated from each other with a large clearance therebeween and almost no parallel portion is formed in the wiring portions 1600, 1601.

Figure 11:
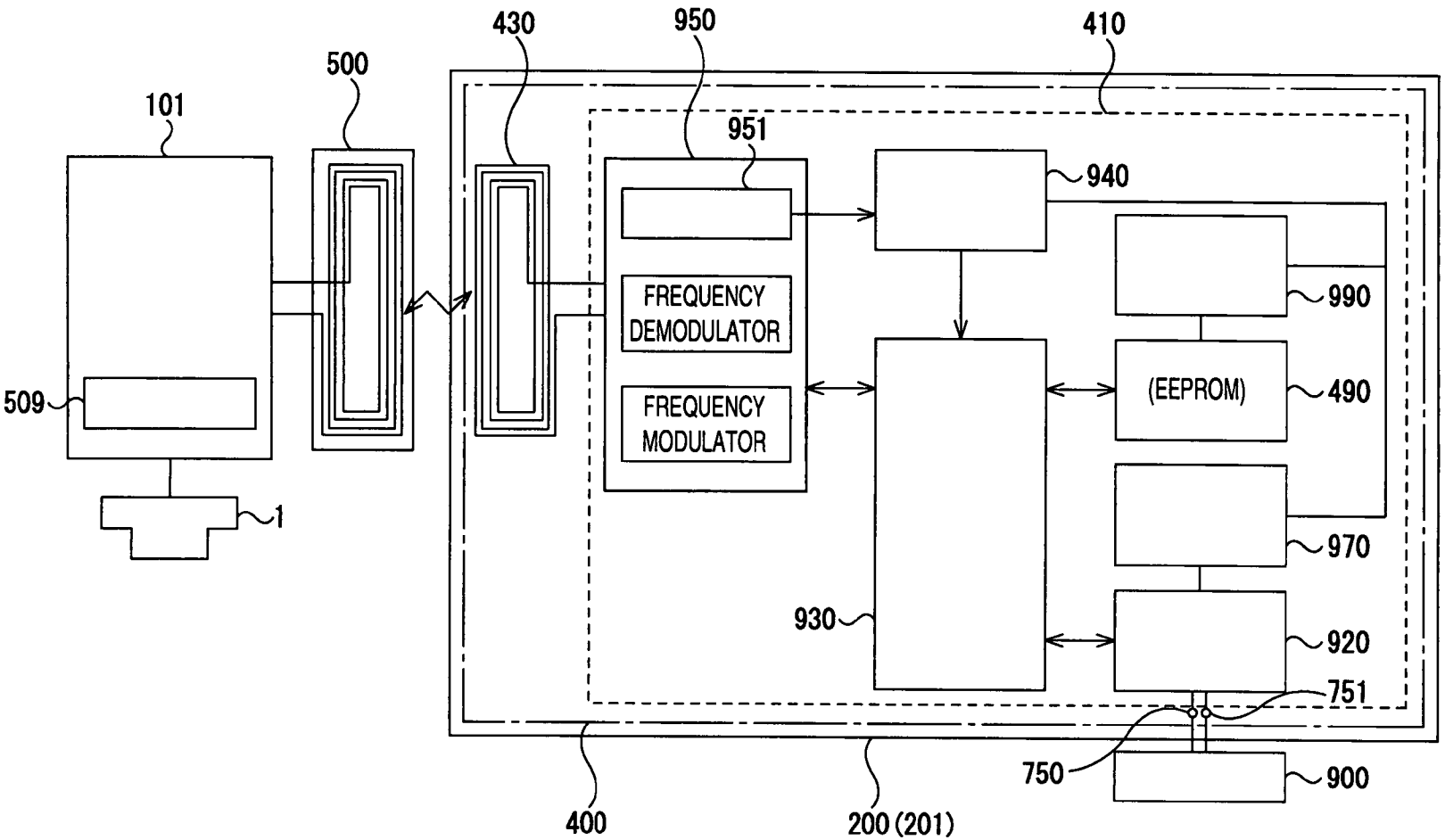
FIG. 11 is a diagram showing an example of a system for wireless communication between the information communicating member and a main body side according to the present invention.

When the information communicating member of the comparative example shown in FIG. 17 is used, noise of radio wave, for example, from the antenna board 500 on the main body 101 side of FIG. 11 may be superposed on a sensor signal passing through the wiring portions 1600, 1601. Further, noise of radio wave from an outside apparatus may be superposed on the sensor signal of the wiring portions 1600, 1601.

In the case of the wiring portions 1600, 1601 in which the wiring clearance is wide and almost no parallel portion is formed, noise of radio wave is superposed on the sensor signal and the sensor signal does not become an accurate value.

Hence, as shown by FIG. 14 and FIG. 16, the connecting wire portions 771, 772 of the invention are designed to be as parallel as possible and to have a narrowed clearance between the connecting wire portions 771, 772.

This design contributes to reducing a possibility that noise of radio wave from the antenna board 500 shown by FIG. 11 is superposed to the sensor signal passing through the connecting wire portions 771, 772. Further, the connecting wire portions 771, 772 of this design can also prevent noise of radio wave of another apparatus at outside of the recording apparatus from being superposed to the sensor signal.

Therefore, the sensor signal passing through the connecting wire portions 771, 772 can be supplied to the information storing portion 710 side as an accurate value and the remaining amount of ink can accurately be obtained.

Figure 8:
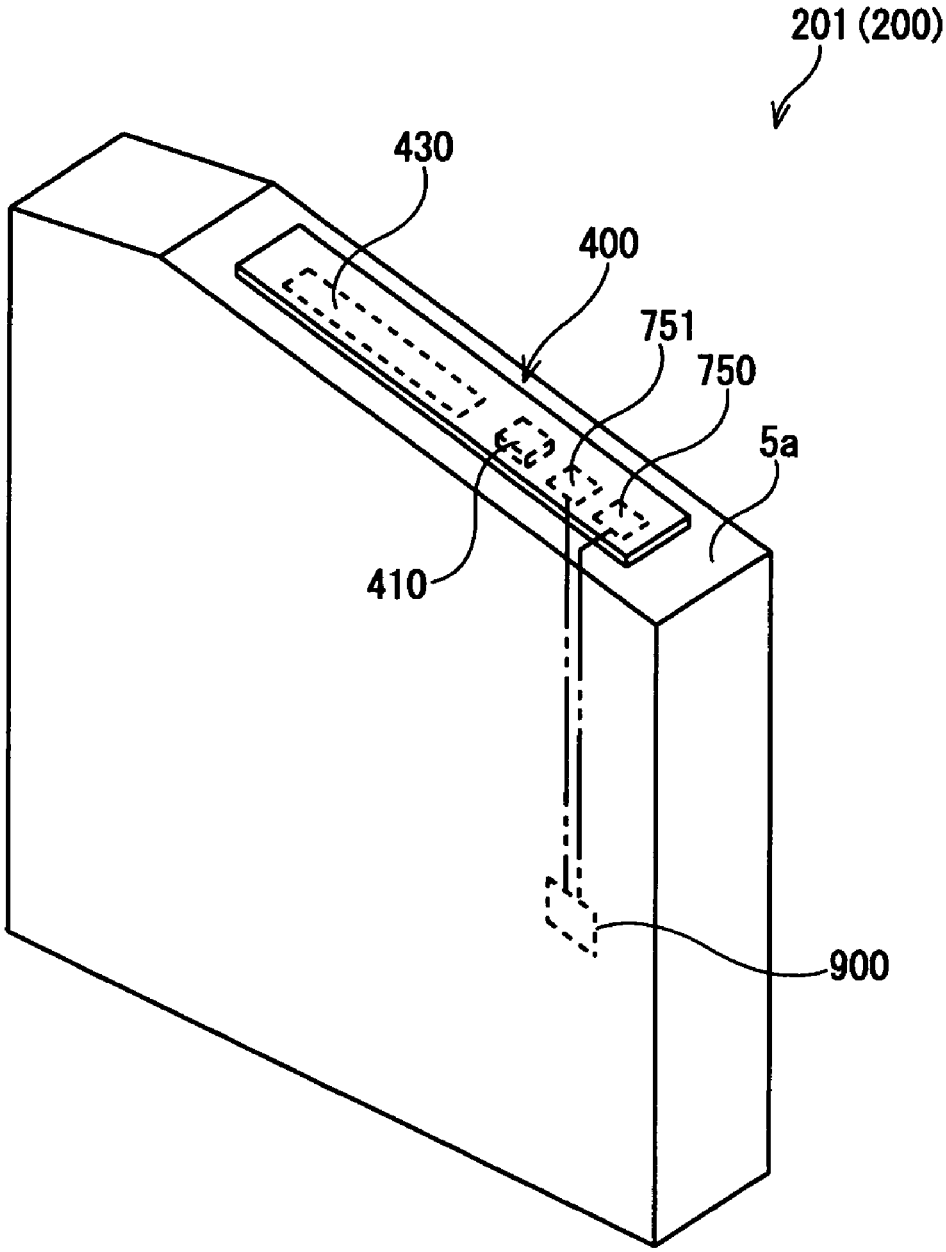
FIG. 8 is a perspective view showing the ink cartridge, the information communicating member and a sensor according to the present invention.

FIG. 8 schematically shows the shape of the ink cartridge 201 and FIG. 9 shows an example of the ink cartridge 201 and an antenna board 500.

The information communicating member 400 as discussed with reference to the first and second preferred embodiments has been already attached onto the upper wall face 5*a* of the ink cartridge 201 in FIGS. 8 and 9.

In a state in which the information communicating member 400 is attached onto the upper wall face 5*a* of the ink cartridge 201, all of elements, such as the information storing portion 410, the antenna circuit portion 430 and the like shown in, for example, FIG. 10 are brought into close contact with the upper wall face 5*a* side and all of the elements are protected from the outside by the base member 440.

In the case in which the protecting layer 700 has a function of shielding the outside ultraviolet ray L and therefore., information with regard to ink of the non-volatile memory 490 can be protected from the outside ultraviolet ray L even in the state in which the information communicating member 400 is attached in this way. The shape of the ink cartridge 200 is similar to the shape of the ink cartridge 201.

As shown by FIG. 8 and FIG. 9, the sensor terminal portions 750, 751 of the information communicating member 400 are connected to a sensor 900. The sensor 900 is the sensor for detecting a remaining amount of ink 910 which is an example of a liquid contained in the inside of the ink cartridge 200 shown in FIG. 10.

As the sensor 900, a sensor utilizing, for example, a piezoelectric vibrator can be used. The sensor 900 can transmit an alternating current waveform changed in accordance with an amount of the ink 910 as a sensor signal to the information storing portion 410 via the sensor terminal portions 750, 751.

FIG. 11 shows an example of a system for exchanging information with regard to ink and supplying operating power between the information storing portion 410 as shown in FIG. 8 and as discussed with reference to the first and second preferred embodiments and the main body 101 of the recording apparatus in a non-contact and wireless manner.

The information communicating member 400 shown in FIG. 11 is mounted to the ink cartridge 200, 201 side.

The sensor 900 is electrically connected to an ink amount detecting portion 920 of the information storing portion 410 via the sensor terminal portions 750, 751.

The information storing portion 410 is also referred to as an electronic element and includes, for example, a control portion 930, the ink amount detecting portion 920, a sensor drive voltage generating portion 970, the non-volatile memory 490, a power generating portion 940, a high frequency wave transmitting and receiving portion 950, a program voltage generating portion 990 and the like.

The high frequency wave transmitting and receiving portion 950 is connected to the antenna circuit portion 430.

The recording head 1 and the antenna board 500 are connected to the main body 101 side of the recording apparatus shown in FIG. 11. In a state in which the cover 109 shown in FIG. 1 is closed, the antenna board 500 is opposed to the antenna circuit portion 430 of the information communicating member 400 at a predetermined clearance therebetween as shown in FIG. 9.

However, a position of arranging the antenna board 500 is not limited to the inner face of the cover 109 but may be other portion.

For example, when the carriage 2 of FIG. 1 is moved along the T direction, a control portion 509 of the main body 101 of the recording apparatus as shown in FIG. 11 detects movement of the carriage 2 of FIG. 1 to output a carrier wave from the antenna board 500 shown in FIG. 11.

The carrier wave is received by the antenna circuit portion 430 of the ink cartridge 200 or 201. The received carrier wave passes through a wave dividing portion 951 of the high frequency wave transmitting and receiving portion 950 shown in FIG. 11 and then inputs into the power generating portion 940 where it is converted into direct current power.

Operating power converted into the direct current power is charged to a charging portion, not illustrated. The operating power operates the information storing portion 410 by being transmitted from the charging portion to the program voltage generating portion 990, the sensor drive voltage generating portion 970, and the control portion 930 of the information storing portion 410.

At a time point after elapse of a time period necessary for charging the charging portion, transmission of the carrier wave from the antenna board 500 on the main body 101 side of the recording apparatus shown in FIG. 11 to the antenna circuit portion 430 on the information communicating member 400 side is stopped.

When the control portion 930 and the sensor 900 are supplied with power from the electricity storing portion (the charging portion), the ink amount detecting portion 920 calculates the ink remaining amount based on the sensor signal from the sensor 900. The ink remaining amount and the information with regard to ink previously stored in the non-volatile memory 490 are transmitted from the antenna circuit portion 430 to the antenna board 500 on the main body 101 side of the recording apparatus as a high frequency signal via the high frequency wave transmitting and receiving portion 950 by instruction of the control portion 930.

By repeating such an operation, the information with regard to ink and the power can be transmitted and received between the ink cartridges 200, 201 and the main body 101 of the recording apparatus by wireless communication.

Incidentally, the invention is not limited to the above-described embodiments.

According to the information communicating member as discussed with reference to the first and second preferred embodiments, as shown by, for example, FIGS. 6, 14, 16, the base member 440 and the peelable sheet 460 are members in a strip-like or an elongated rectangular shape. However, the invention is not limited thereto but the shape of the base member 440 and the peelable sheet 460 may be constituted by other shape in consideration of the shape of the antenna circuit portion, the shape of the sensor terminal portion or the like. For example, a circular shape, an elliptical shape, a triangular shape or other shape can be adopted.

The numbers of the ink cartridges 200, 201 shown in FIG. 2 are not limited thereto but there can be adopted a type aligning one piece, two pieces or five pieces or more as the numbers of the ink cartridges. In that case, the information communicating members 400 are respectively attached to those ink cartridges.

The antenna board 500 shown in FIG. 1 and FIG. 9 is arranged on the inner face side of the cover 109. However, the invention is not limited thereto but the location of the antenna board 500 can be changed in accordance with the shape or the type of the ink jet type recording apparatus 100 so far as the antenna board 500 can be proximate to the information communicating members 400 of the respective ink cartridges 200, 201.

The ink jet type recording apparatus 100 shown in FIG. 1 is the normal recording apparatus for color printing.

However, the apparatus is not limited thereto but in the case of the ink jet type recording apparatus for printing by a large amount or printing characters, the apparatus is constructed by a structure in which each ink cartridge is provided with a large capacity and a carriage contains the ink cartridge having such a large capacity. The recording apparatus of the invention may be constituted by such an ink jet type recording apparatus for printing by a large amount.

The information communicating member of the invention is applicable not only to an ink cartridge of the ink jet type recording apparatus but to an ink cartridge of a recording apparatus of other type.

The invention is not limited to the above-described embodiments of the ink jet type recording apparatus but can variously be modified within the range not deviated from the scope of claims.

For example, the liquid ejecting apparatus of the invention may be constituted by a liquid ejecting apparatus for ejecting other liquid. The liquid ejecting apparatus of the invention may be constituted by a liquid ejecting apparatus for ejecting an electrode material or a colorant used in fabricating a liquid crystal display, an EL display and a face luminescent display, a liquid ejecting apparatus for ejecting a living body organic substance used in fabricating a biochip, or a sample ejecting apparatus as a fine pipet.

Respective constitutions of the embodiments can arbitrarily be combined such that portions thereof are omitted or differently from the above-described.

Moreover, the information communicating member according to the present invention can be applied not only to a liquid container mountable onto a liquid ejecting device, but also to other articles that are required to hold information and transmit the information. For example, the information communicating member according to the present invention may be attached to a toner cartridge mountable onto a laser printer.

What is claimed is:

1. An information communicating member to be disposed on a liquid container for supplying a liquid to a liquid ejecting head of a liquid ejection apparatus, the information communicating member comprising:

an information storing portion storing therein liquid information with regard to the liquid contained in the liquid container;

an antenna portion for communicating the liquid information stored in the information storing portion between the information communicating member and the liquid ejection apparatus in a wireless manner; and a base member having a surface on which both the information storing portion and the antenna portion are directly disposed, the base member having an electric insulating property and an ultraviolet ray shielding property, wherein the base member includes:

a protecting layer having the electric insulating property and the ultraviolet ray shielding property for protecting the information storing portion and the antenna portion; and an adhering layer adhering the information storing portion and the antenna portion to the protecting layer and for attaching the information storing portion, the antenna portion and the protecting layer with respect to the liquid container, an exposed portion of the adhering layer being the surface on which the information storing portion and the antenna portion are directly disposed.

2. An information communicating member to be disposed on a liquid container for supplying a liquid to a liquid ejecting head of a liquid ejection apparatus, the information communicating member comprising:

an information storing portion storing therein liquid information with regard to the liquid contained in the liquid container;

an antenna portion for communicating the liquid information stored in the information storing portion between the information communicating member and the liquid ejection apparatus in a wireless manner;

a base member having a surface on which both the information storing portion and the antenna portion are directly disposed, the base member having an electric insulating property and an ultraviolet ray shielding property, the base member including;

a protecting layer having the electric insulating property and the ultraviolet ray shielding property for protecting the information storing portion and the antenna portion, and an adhering layer adhering the information storing portion and the antenna portion to the protecting layer and for attaching the information storing portion, the antenna portion and the protecting layer with respect to the liquid container, an exposed portion of the adhering layer being the surface on which the information storing portion and the antenna portion are directly disposed; and a jumper connecting line for electrically connecting the information storing portion to the antenna portion, the jumper connecting line being disposed within the adhering layer.

3. An information communicating member to be disposed on a liquid container for supplying a liquid to a liquid ejecting head of a liquid ejection apparatus, the information communicating member comprising:

an information storing portion storing therein liquid information with regard to the liquid contained in the liquid container;

an antenna portion for communicating the liquid information stored in the information storing portion between the information communicating member and the liquid ejection apparatus in a wireless manner;

a base member having a surface on which both the information storing portion and the antenna portion are directly disposed, the base member having an electric insulating property and an ultraviolet ray shielding property; and a peelable sheet removably attached to the base member for covering and protecting the information storing portion and the antenna portion of the base member, the peelable sheet having electric insulating property and ultra violet ray shielding property.

4. An information communicating member to be disposed on a liquid container for supplying a liquid to a liquid ejecting head of a liquid ejecting apparatus, the information communicating member comprising:

an information storing portion and storing therein liquid information with regard to the liquid contained in the liquid container;

an antenna portion for communicating the liquid information stored in the information storing portion between the information communicating member and the liquid ejecting apparatus in a wireless manner;

a plurality of sensor terminal portions for electrically connecting the information storing portion to a sensor for detecting a remaining amount of the liquid in the liquid container;

a base member having a surface on which the information storing portion, the antenna portion and the sensor terminal portions are directly disposed; and a plurality of connecting wire portions electrically connecting the sensor terminal portions and the information storing portion, the connecting wire portions being at least in part aligned in parallel with each other on the base member, wherein the base member includes:

a protecting layer for protecting the information storing portion, the antenna portion, the sensor terminal portions and the connecting wire portions; and an adhering layer for attaching the information storing portion, the antenna portion, the sensor terminal portions and the connecting wire portions to a liquid container side of the protecting layer, an exposed portion of the adhering layer being the surface on which the information storing portion, the antenna portion, the sensor terminal portions and the connecting wire portions are directly disposed.

5. The information communicating member according to claim 4, wherein the connecting wire portions electrically connect the sensor terminal portions to two terminals of the information storing portion, respectively, and the information communicating member transmits and receives the liquid information to and from the liquid ejecting apparatus and receives a power from the liquid ejecting apparatus.

6. An information communicating member comprising:

a flexible base substrate having a first surface on which a memory device and an antenna connected to the memory device are disposed, and an opposite second surface;

a flexible first protective substrate laminated on the second surface of the flexible base substrate;

a flexible second protective substrate having a first surface and an opposite second surface, wherein:

the first surface of the flexible second protective substrate has an electrically insulating property and is laminated on the first surface of the flexible base substrate so that the memory and the antenna are covered between the flexible base substrate and the flexible second protective substrate; and the second surface of the flexible second protective substrate has an adhesive property.

7. The information communicating member according to claim 6, wherein at least one of the flexible base substrate and the flexible first protective substrate has an ultraviolet ray shielding property.

8. The information communicating member according to claim 6, wherein at least one of the flexible base substrate and the flexible first protective substrate has an electrically insulating property.

9. The information communicating member according to claim 6, further comprising:

a plurality of terminal portions for electrical connection to an external device; and a plurality of connecting wire portions electrically connecting the terminal portions to the memory device, wherein the connecting wire portions are at least in part aligned in parallel with each other on the first surface of the flexible base substrate.

* * * * *